US011377268B2

(12) United States Patent
Naomi et al.

(10) Patent No.: US 11,377,268 B2
(45) Date of Patent: Jul. 5, 2022

(54) SEALABLE CONTAINER SYSTEM

(71) Applicant: Zipporo LLC, Brooklyn, NY (US)

(72) Inventors: Leah Naomi, Brooklyn, NY (US); Steven Dibdin, Bloomfield, NJ (US); Alaina Appelbaum, Brooklyn, NY (US); Edward Laganis, Hoboken, NJ (US)

(73) Assignee: Zipporo LLC, Brooklyn, NY (US)

( * ) Notice: Subject to any disclaimer, the term of this patent is extended or adjusted under 35 U.S.C. 154(b) by 84 days.

(21) Appl. No.: 16/937,591

(22) Filed: Jul. 24, 2020

(65) Prior Publication Data

US 2020/0354115 A1 Nov. 12, 2020

Related U.S. Application Data

(62) Division of application No. 16/159,466, filed on Oct. 12, 2018, now abandoned.

(Continued)

(51) Int. Cl.
*B65D 43/02* (2006.01)
*B65D 6/00* (2006.01)

(Continued)

(52) U.S. Cl.
CPC ..... *B65D 43/021* (2013.01); *B65D 11/00* (2013.01); *B65D 43/06* (2013.01); *B65D 43/26* (2013.01);

(Continued)

(58) Field of Classification Search
CPC ..... B65D 2543/00824; B65D 2543/00944; B65D 2543/00953; B65D 2543/0099; B65D 2543/00; B65D 2543/0049; B65D 2543/00564; B65D 2543/00962; B65D 2543/00629; B65D 2543/00583;

(Continued)

(56) References Cited

U.S. PATENT DOCUMENTS

2002/0160133 A1 10/2002 Jeter et al.
2009/0155365 A1* 6/2009 Je ..... A61K 9/06 424/486

(Continued)

FOREIGN PATENT DOCUMENTS

CA 2573202 A1 7/2008
CN 101259887 A 9/2008

(Continued)

*Primary Examiner* — Don M Anderson
(74) *Attorney, Agent, or Firm* — North Shore Patents, P.C.

(57) ABSTRACT

A sealable container system contains a body and a lid assembly. The body includes an internal volume defined by bottom and side wall(s), bump(s) on the inside surface of the side wall and projecting toward the internal volume, and a lid with outer and inner walls at its bottom side with a channel in-between. A gasket couples to the lid with a wall portion residing within the channel and a lip outside the channel. When the lid assembly is pressed into the body, the lip of the gasket engages the bumps and deforms, and a gap forms between the lip and the side wall, where air in the internal volume exits through the gap. When the lip of the gasket travels past the bumps, the lip fully seats against the inside surface of the side wall, where negative air pressure is imparted to the internal volume of the body.

4 Claims, 28 Drawing Sheets

Related U.S. Application Data

(60) Provisional application No. 62/575,433, filed on Oct. 21, 2017.

(51) Int. Cl.

| | |
|---|---|
| ***B65D 43/06*** | (2006.01) |
| ***B65D 43/26*** | (2006.01) |
| ***B65D 53/02*** | (2006.01) |
| ***B65D 55/04*** | (2006.01) |

(52) U.S. Cl.

CPC ..... *B65D 53/02* (2013.01); *B65D 55/04* (2013.01); *B65D 2251/005* (2013.01); *B65D 2251/0018* (2013.01); *B65D 2251/0081* (2013.01); *B65D 2251/065* (2013.01); *B65D 2251/20* (2013.01); *B65D 2543/00194* (2013.01); *B65D 2543/00296* (2013.01); *B65D 2543/00518* (2013.01); *B65D 2543/00546* (2013.01); *B65D 2543/00564* (2013.01); *B65D 2543/00629* (2013.01); *B65D 2543/00694* (2013.01); *B65D 2543/00759* (2013.01); *B65D 2543/00805* (2013.01); *B65D 2543/00972* (2013.01)

(58) Field of Classification Search

CPC ..... B65D 2543/00592; B65D 2543/00601; B65D 2543/00481; B65D 2543/00444; B65D 2543/00611; B65D 2543/00694; B65D 2543/00703; B65D 2543/00731; B65D 2543/00712; B65D 2543/0074; B65D 2543/00796; B65D 2543/00805; B65D 2543/00814; B65D 51/1666; B65D 51/1672; B65D 51/16; B65D 51/1611; B65D 51/1622; B65D 51/1627; B65D 51/1633; B65D 51/165; B65D 51/1661; B65D 51/1668; B65D 51/1694; B65D 43/0206; B65D 43/0204; B65D 43/021; B65D 43/26; B65D 11/00; B65D 43/06; B65D 53/02; B65D 55/04; B65D 2251/0018; B65D 2251/005; B65D 2251/0081; B65D 2251/065; B65D 2251/20; B65D 2543/00194; B65D 2543/00296; B65D 2543/00518; B65D 2543/00546

See application file for complete search history.

(56) References Cited

U.S. PATENT DOCUMENTS

| | | | | |
|---|---|---|---|---|
| 2010/0147846 | A1* | 6/2010 | Soibel | B65D 43/0233 220/202 |
| 2013/0327770 | A1* | 12/2013 | Turvey | B65D 43/021 220/212 |
| 2014/0312108 | A1* | 10/2014 | Kroll | B65D 43/0218 229/120 |
| 2018/0002076 | A1* | 1/2018 | Wada | B65D 43/163 |
| 2018/0009579 | A1* | 1/2018 | Wada | B65D 45/32 |
| 2021/0284398 | A1* | 9/2021 | Valderrama | B65D 43/022 |

FOREIGN PATENT DOCUMENTS

| | | | |
|---|---|---|---|
| EP | 0112691 | A3 | 8/1984 |
| WO | WO2010/121295 | * | 10/2010 |
| WO | 2012053734 | A1 | 4/2012 |
| WO | 2016152050 | A1 | 9/2016 |

* cited by examiner

SEALABLE CONTAINER SYSTEM

BACKGROUND OF THE INVENTION

Food containers for home use that provide for a negative air pressure (relative to ambient air pressure) are known in the prior art, and typically employ a complicated one-way valve on a lid or some other valve, nozzle, or air-pump mechanism. Such mechanisms are necessarily opaque in many cases, which hinders the view of food items that may be contained in such containers. Also, such mechanisms add to the cost of such products, and complicate their operation. Many of these containers fail to provide a strong negative-pressure seal when closed and or will leak when upended.

Further, many such prior art containers are necessarily circular in plan view so that pressure is evenly distributed around the rim of the container and the lid. This is necessary with many prior art devices due to the valve mechanism or sealing mechanism utilized with such devices. With these prior art mechanisms, a square or rectangular container that has a seal having a point or radiused corner doesn't properly function to maintain a negative air pressure within the container.

BRIEF SUMMARY OF THE INVENTION

Disclosed herein is a sealable container system as specified in the independent claims. Embodiments of the present invention are given in the dependent claims. Embodiments of the present invention can be freely combined with each other if they are not mutually exclusive.

According to one embodiment of the present invention, a sealable container system includes a body and a lid assembly. The body includes: an open top end; a closed bottom end; at least one side wall, where the closed bottom end and the at least one side wall defines an internal volume in the body; and one or more bumps residing on the at least one side wall and projecting away from an inside surface of the at least one side wall and toward the internal volume. The lid assembly includes: a lid with a top side and a bottom side opposite the top side; an outer wall and an inner wall residing at the bottom side and projecting downward from the bottom side; a channel between the outer wall and the inner wall; and a gasket that includes a wall portion and a lip. When the gasket engages the lid, the wall portion resides within the channel and the lip resides outside the channel.

When the lid assembly is pressed into the open end of the body, the lip of the gasket engages the one or more bumps and deforms to accommodate the one or more bumps, where a gap between the lip of the gasket and the inside surface of the at least one side wall is formed, where air in the internal volume exits through the gap.

When the lip of the gasket engages the one or more bumps and deforms to accommodate the one or more bumps, a gap between the lip of the gasket and the inside surface of the at least one side wall is formed, where air in the internal volume exits through the gap.

DETAILED DESCRIPTION OF THE INVENTION

The following description is presented to enable one of ordinary skill in the art to make and use the present invention and is provided in the context of a patent application and its requirements. Various modifications to the embodiment will be readily apparent to those skilled in the art and the generic principles herein may be applied to other embodiments. Thus, the present invention is not intended to be limited to the embodiment shown but is to be accorded the widest scope consistent with the principles and features described herein.

Reference in this specification to "one embodiment", "an embodiment", "an exemplary embodiment", or "a preferred embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments. In general, features described in one embodiment might be suitable for use in other embodiments as would be apparent to those skilled in the art.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements but can also mean a singular element.

FIGS. 1-11 illustrate a first exemplary embodiment of the sealable container system according to the present invention.

Figure 1:
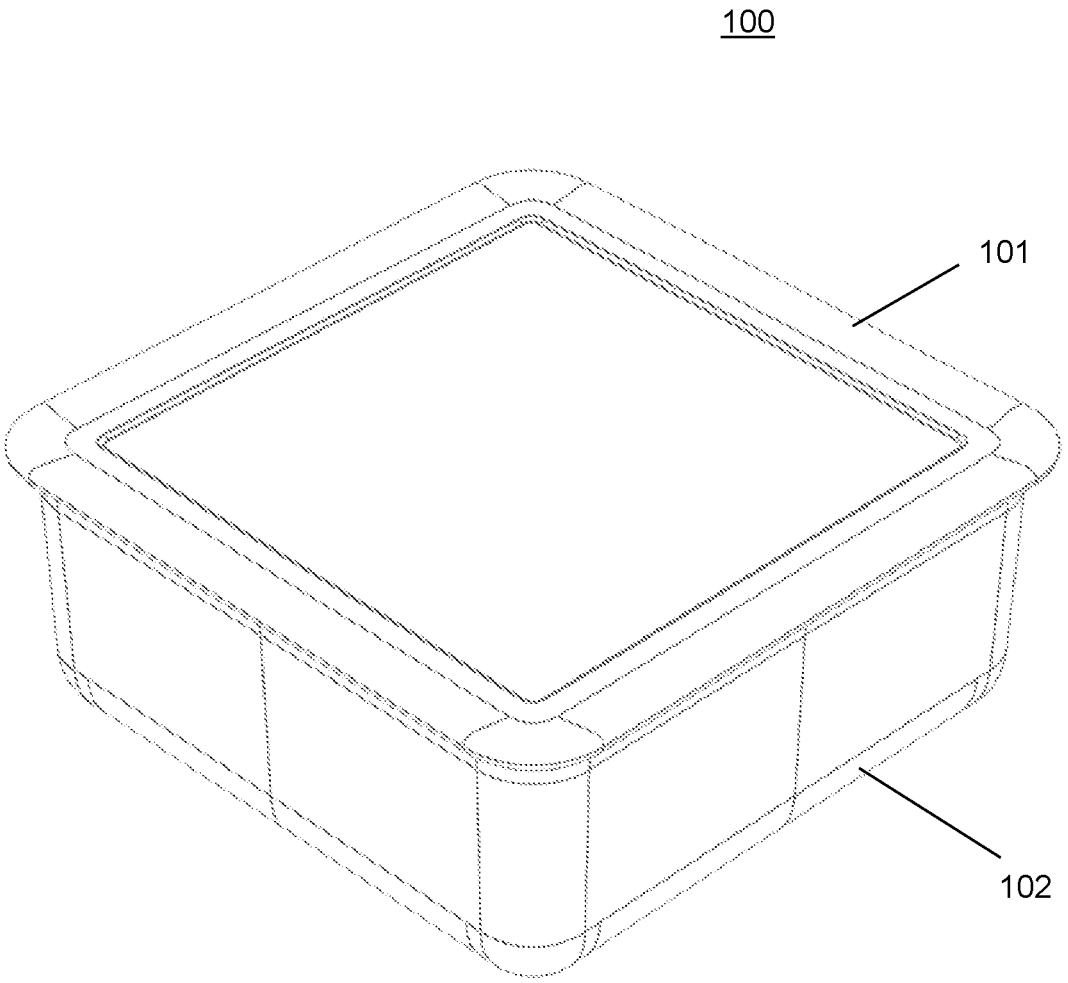
FIGS. 1 and 2 illustrate a top perspective view and a bottom perspective view, respectively, of the sealable container system according to the first exemplary embodiment.
Figure 2:
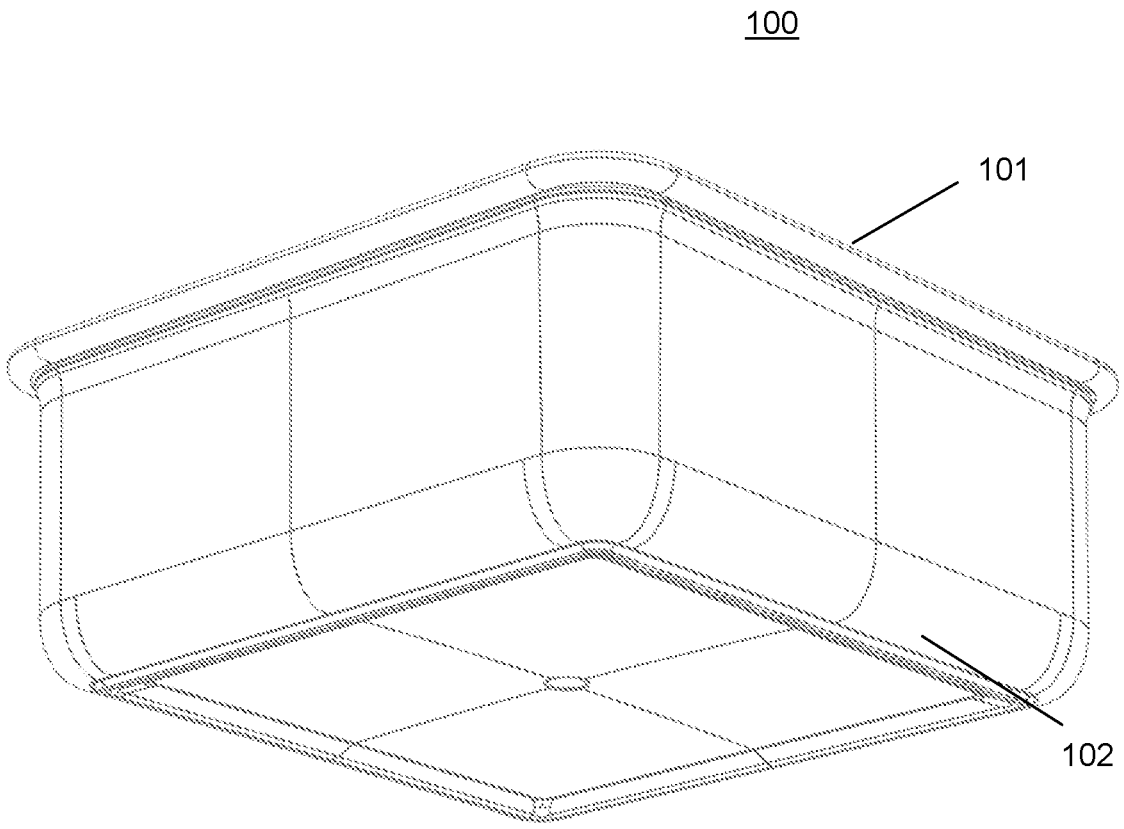
Figure 3:
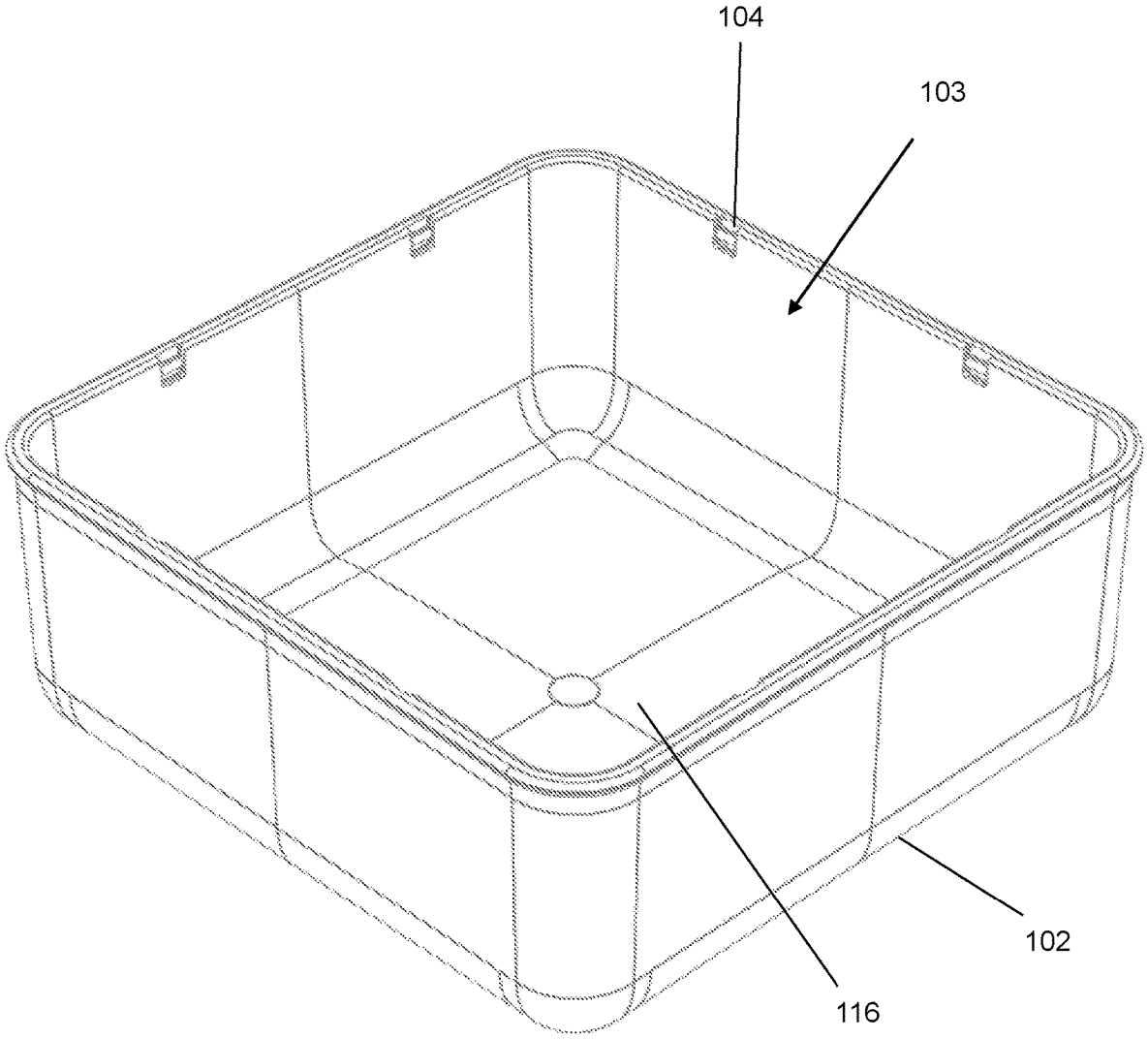
FIG. 3 illustrates a top perspective view of the body of the sealable container system according to the first exemplary embodiment.

FIGS. 1 and 2 illustrate a top perspective view and a bottom perspective view, respectively, of the sealable container system according to the first exemplary embodiment. The sealable container system 100 includes a body 102 and a lid assembly 101. FIG. 3 illustrates a top perspective view of the body of the sealable container system according to the first exemplary embodiment. The body 102 includes an open top end, a closed bottom end 116, and at least one side wall 103. The bottom end 116 and the side walls 103 define an internal volume in the body 102. The side walls 103 include one or more divots 104 residing at the upper edges of the side walls 103 proximate to the open top end and in an inside surface of the side walls 103.

Figure 4:
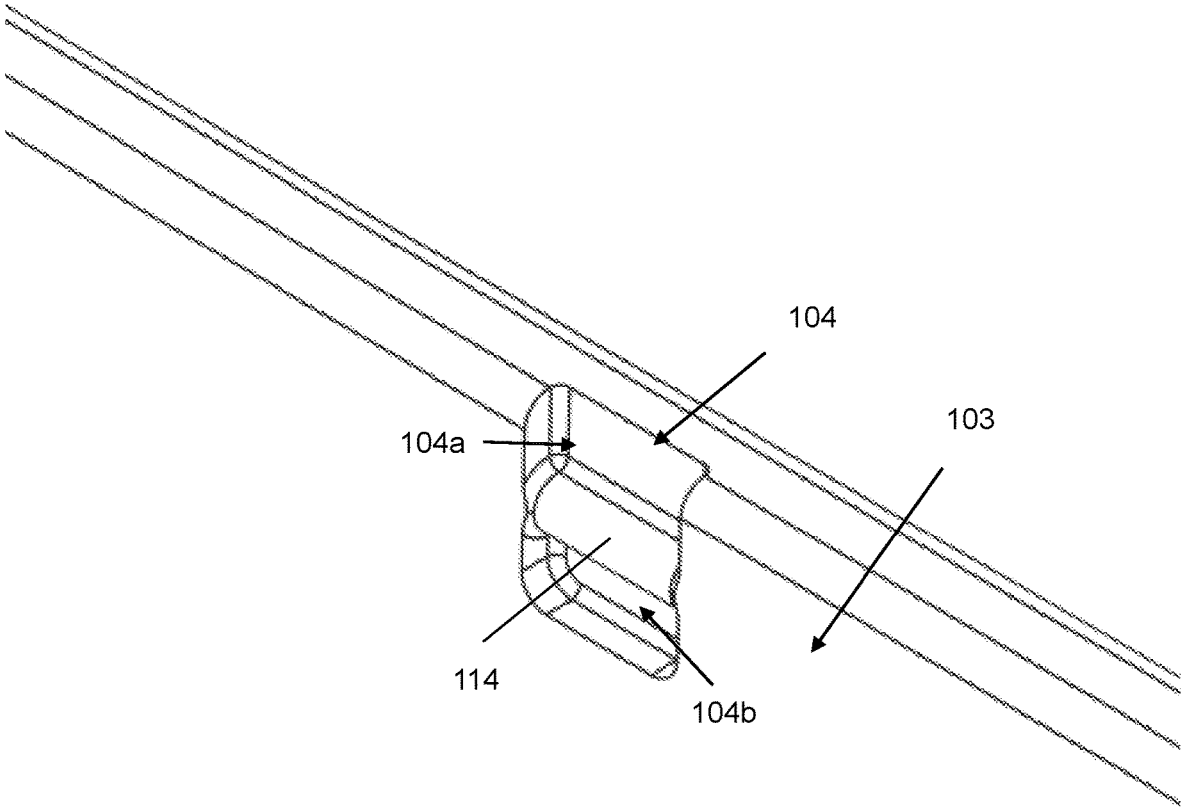
FIG. 4 illustrates a close-up perspective view of the divot according to the first exemplary embodiment.

FIG. 4 illustrates a close-up perspective view of the divot according to the first exemplary embodiment. Each divot 104 is composed of a cavity in the inside surface of the side wall 103 and a bump 114 residing within the cavity and projecting toward the inside volume of the body 102. The divot 104 includes a top cavity 104*a* above the bump 114 and in the upper edge of the side wall 103. The divot 104 further includes a bottom cavity 104*b* under the bump 114 and within the side wall 103. Each divot 104 is able to engage a clip of the lid assembly 101 to seal the container system as described further below. Preferably, the body 102 is made from a semi-rigid material, such as a semi-rigid plastic injection-molded material.

Figure 5:
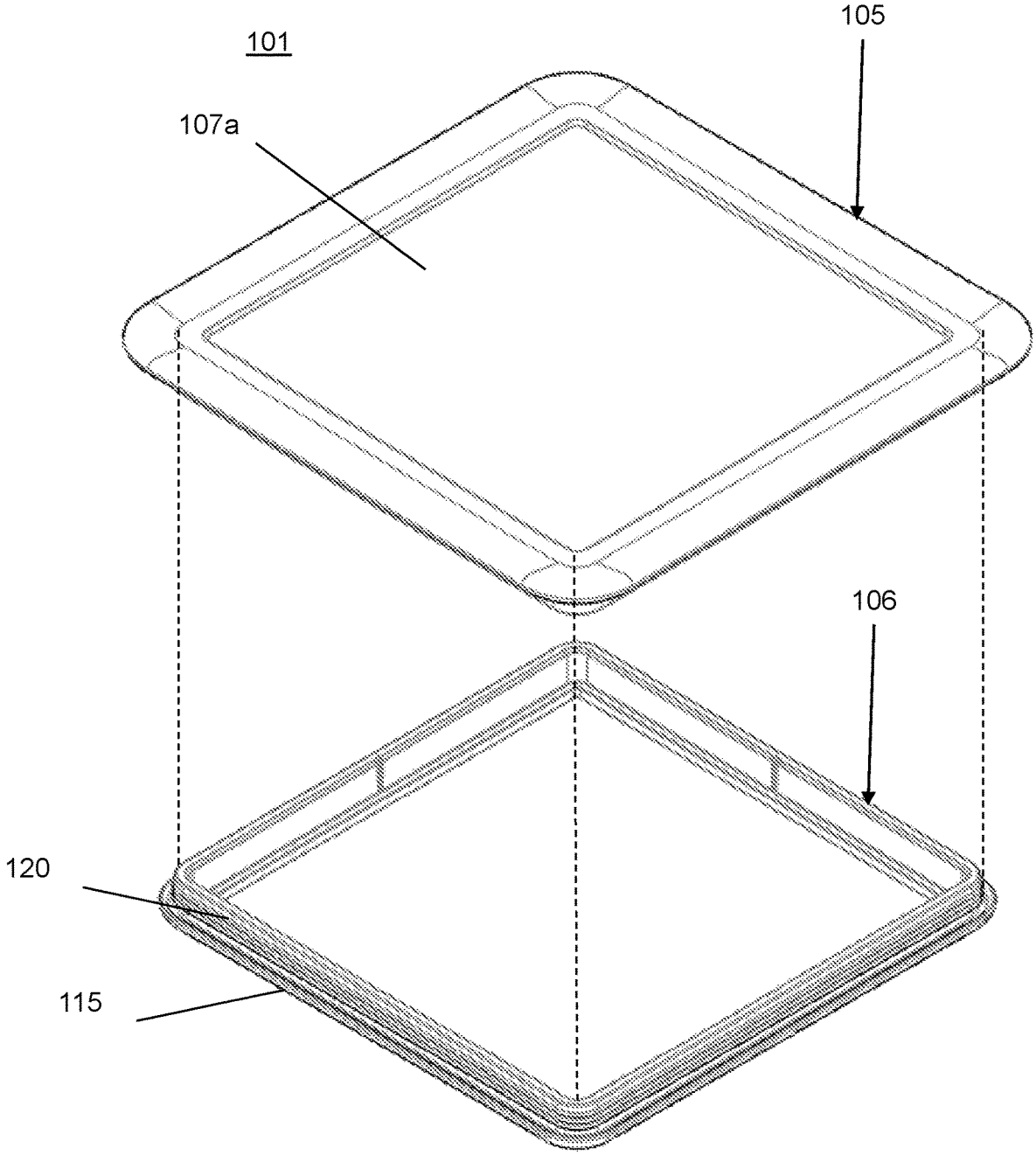
FIGS. 5 and 6 illustrate a top exploded perspective view and a bottom exploded perspective view, respectively, of the lid assembly according to the first exemplary embodiment.
Figure 6:
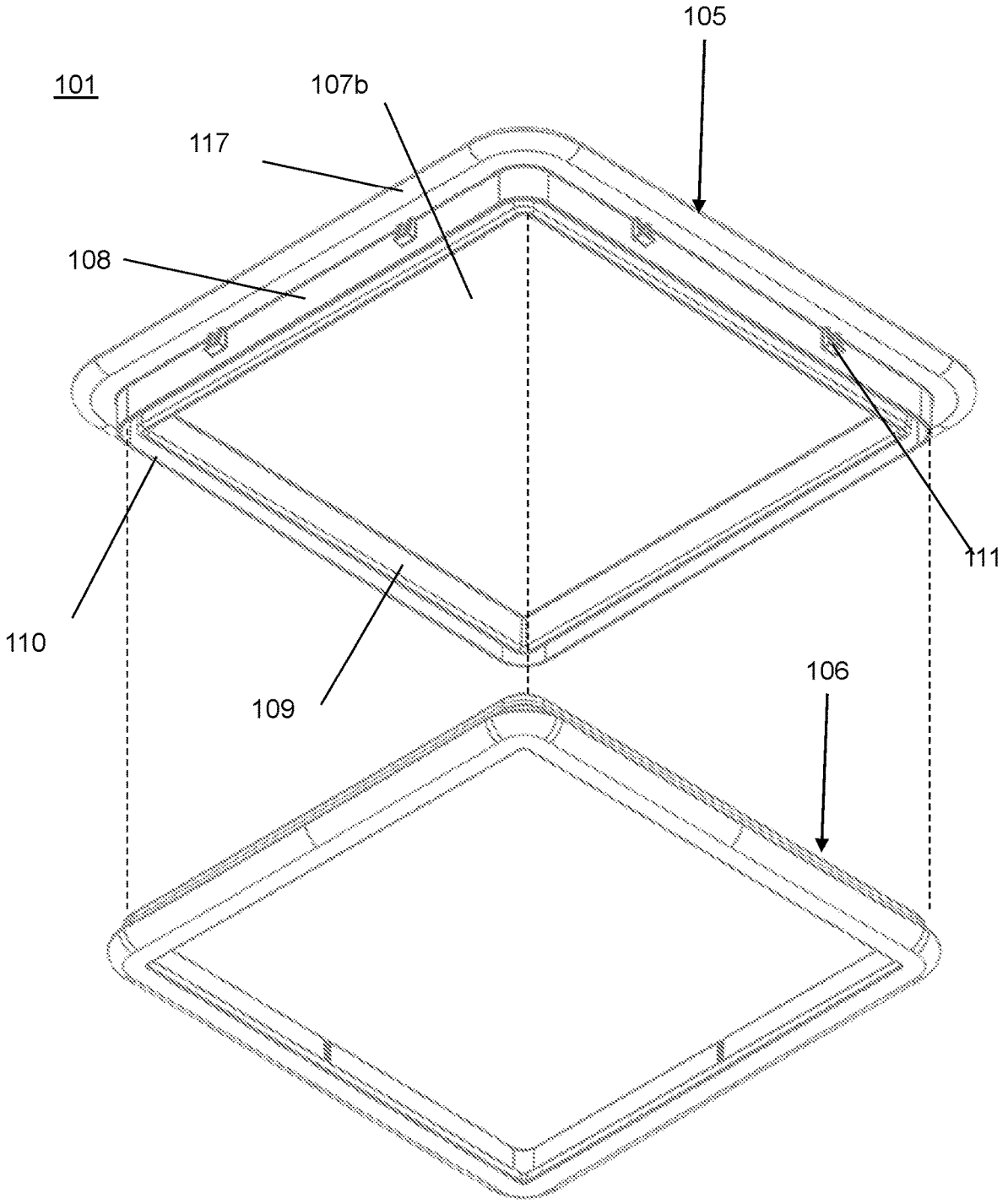

FIGS. 5 and 6 illustrate a top exploded perspective view and a bottom exploded perspective view, respectively, of the lid assembly according to the first exemplary embodiment. The lid assembly 101 includes a lid 105 and an elastomeric gasket 106. The lid 105 includes a top side 107*a* and a bottom side 107*b* opposite the top side 107*a*, with an outer wall 108 and an inner wall 109 residing at the bottom side 107*b* and projecting downward from the bottom side 107*b*. A plurality of clips 111 resides on an outer surface of the outside wall 108. The clips 111 are able to engage the divots 104 of the body 102, as described below. In this exemplary embodiment, when the lid assembly 101 fully engages the body 102, the clips 111 are not visible by a user from outside of the sealable container system 100, and the user need not interact with the clips 111 to engage or disengage the lid assembly 101 from the body 102. The outer 108 and inner 109 walls reside at the bottom side 107*b* such that a channel 110 exists between the outer 108 and inner 109 walls and a lip 117 exists at the outer edges of the lid 105. As illustrated in FIG. 5, the gasket 106 includes a wall portion 120 and a lip 115 at the outer edges of the gasket 106. When engaged with the lid 105, the wall portion 120 of the gasket 106 resides within the channel 110 of the lid 105, while the lip 115 of the gasket 106 resides outside of the channel 110. The lip 115 is configured for resilient deformation, as described further below.

Figure 7:
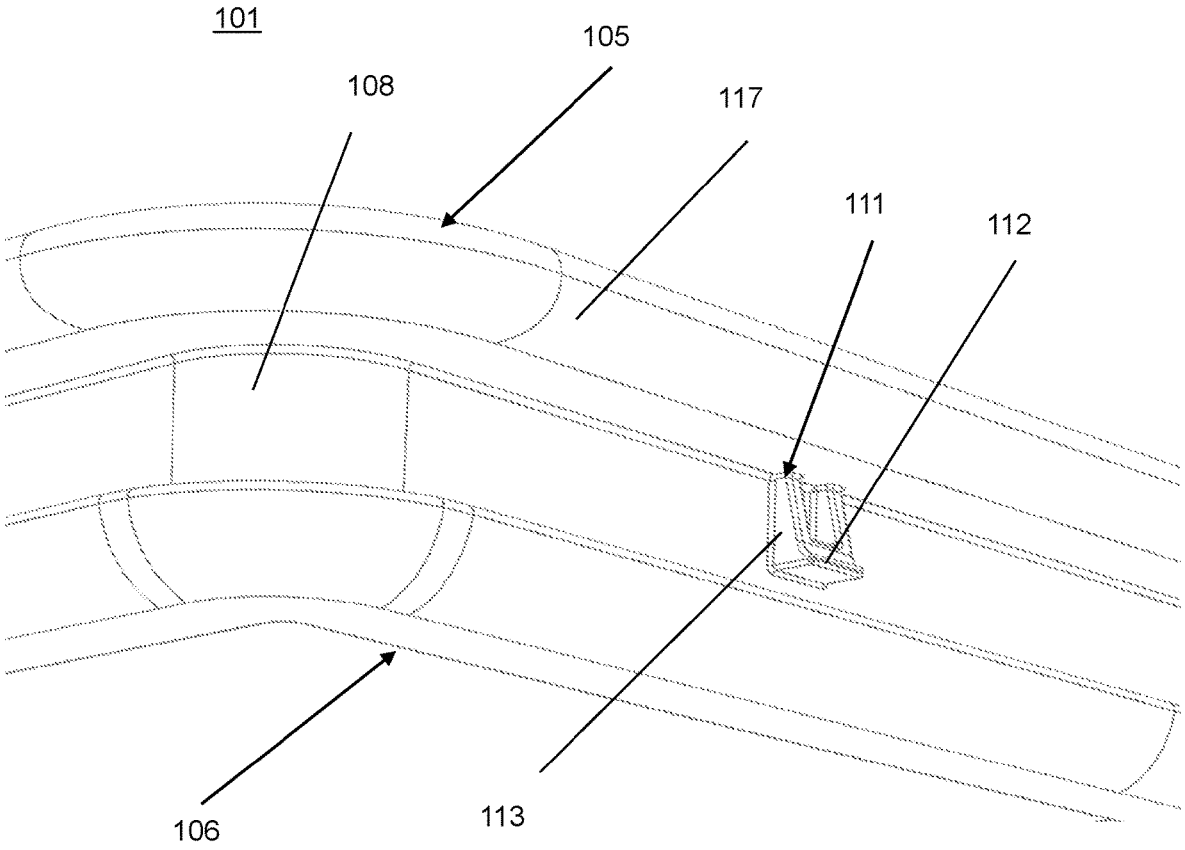
FIG. 7 illustrates close-up perspective views of the lid assembly according to the first exemplary embodiment.
Figure 8:
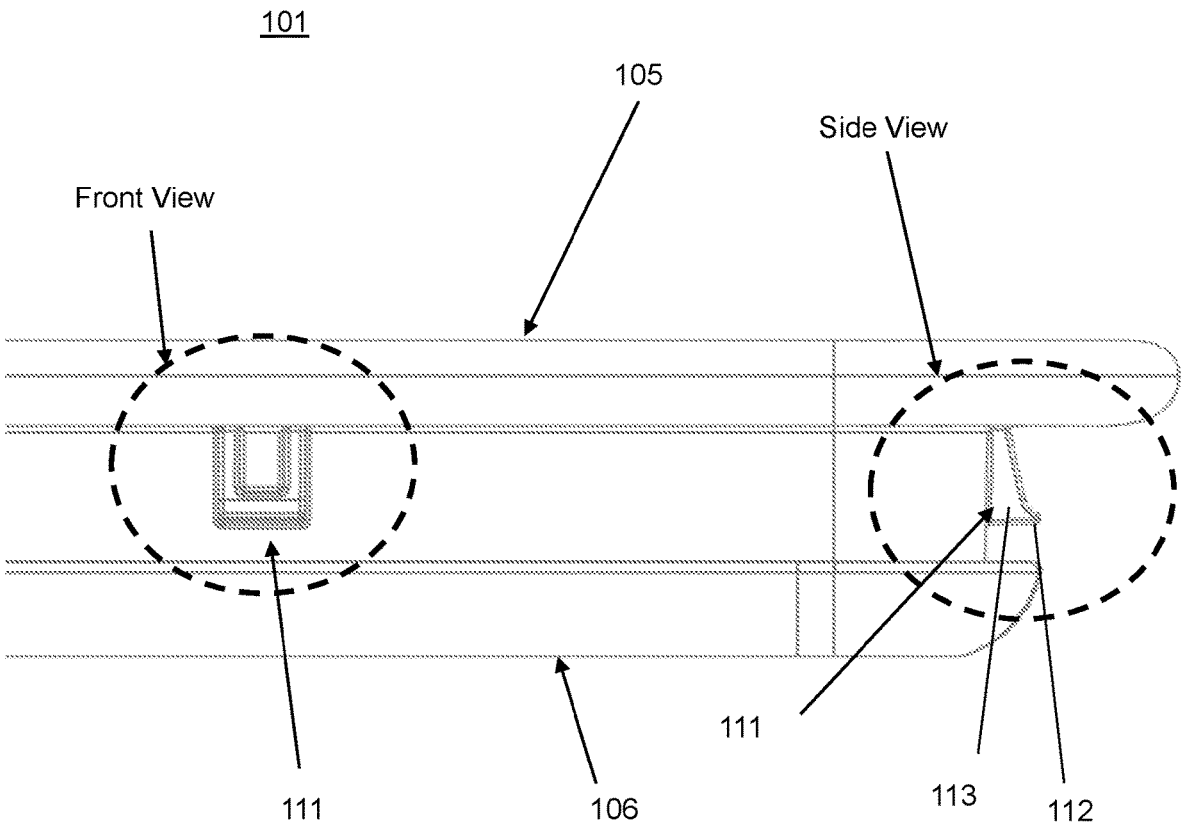
FIG. 8 illustrates close-up front and side views of the clip according to the first exemplary embodiment.

FIG. 7 illustrates a close-up perspective view of the lid assembly according to the first exemplary embodiment. FIG. 8 illustrates close-up front and side views of the clip according to the first exemplary embodiment. The lid assembly 101 includes the lid 105 coupled to the gasket 106, and the lid 105 includes the outer wall 108 and the clip 111. The clip 111 includes a clip protrusion 112 projecting outward from the outer wall 108 and a clip support rib 113 that couples the clip protrusion 112 to the outer surface of the outer wall 108.

Figure 9:
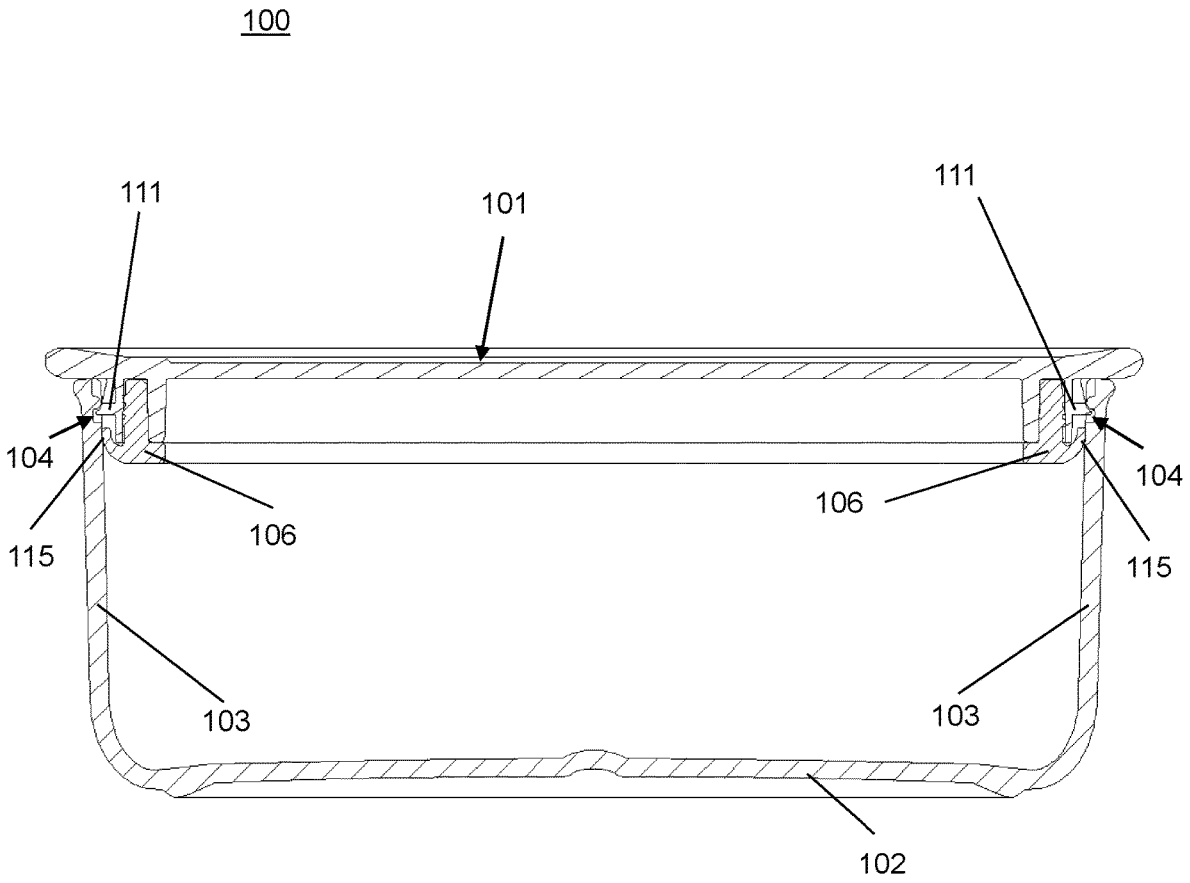
FIG. 9 illustrates a cross-sectional view of the sealable container system according to the first exemplary embodiment.

FIG. 9 illustrates a cross-sectional view of the sealable container system according to the first exemplary embodiment. When the lid assembly 101 engages the body 102 in a closed position, the lip 115 of the gasket 106 fully seats against the inside surface of the side walls 103 of the body 102, and the clips 111 of the lid assembly 101 engages the divots 104.

Figure 10:
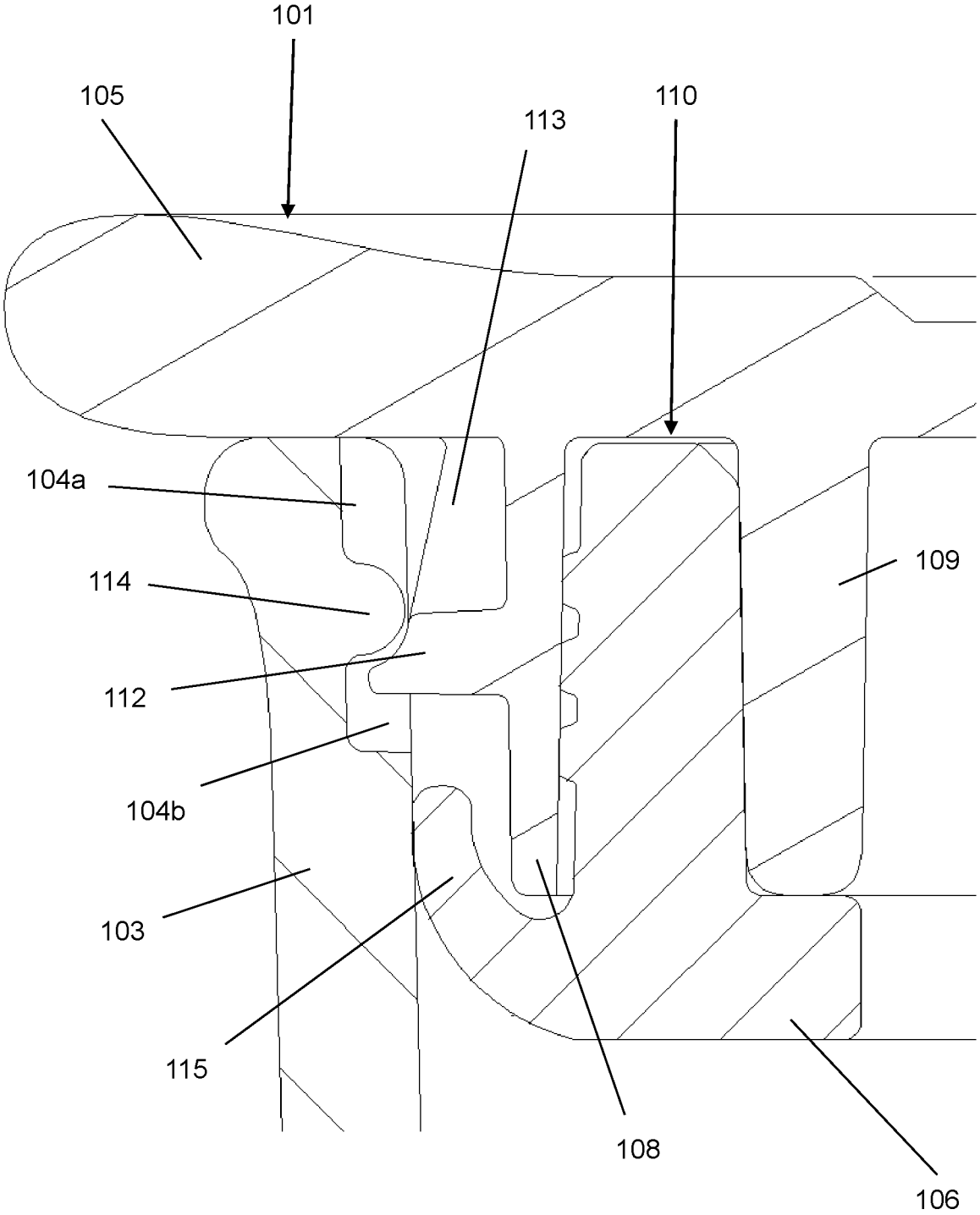
FIG. 10 illustrates a close-up cross-sectional view of the lid assembly in a closed position according to the first exemplary embodiment.

FIG. 10 illustrates a close-up cross-sectional view of the lid assembly in a closed position according to the first exemplary embodiment. As the lid assembly 101 is pressed into the open end of the body 102, the lip 115 of the gasket 106 abuts the divot 104, and the cavities 104*a*-104*b* form a gap between the lip 115 and the inside surfaces of the side walls 103. This allows air in the internal volume of the body 102, that is displaced due to the pressing of the lid assembly 101, to exit through the gap. When the lip 115 travels past the divot 104, the lip 115 fully seats against the inside surfaces of the side walls 103, imparting negative air pressure to the internal volume of the body 102. "Negative air pressure", as used herein, refers to the air pressure in the internal volume of the body being lower than the air pressure outside of the internal volume. The air pressure in the internal volume may include, but is not limited to, a vacuum. The negative air pressure within the body 102 urges the lip 115 of the gasket 106 against the inside surface of the side walls 103. As the lid assembly 101 continues to be pressed into the body 102, the clip protrusion 112 eventually engages the bump 114. In this exemplary embodiment, the clip protrusion 112 engages the lower portion of the bump 114. This creates resistance between the bump 114 and the clip protrusion 112, which assists in holding the lid assembly 101 in the closed position. In this exemplary embodiment, a tactile and/or audio feedback occurs when the clip protrusion 112 engages the bottom portion of the bump 114, signaling to the user that the lid assembly 101 is fully seated on the body 102.

Figure 11:
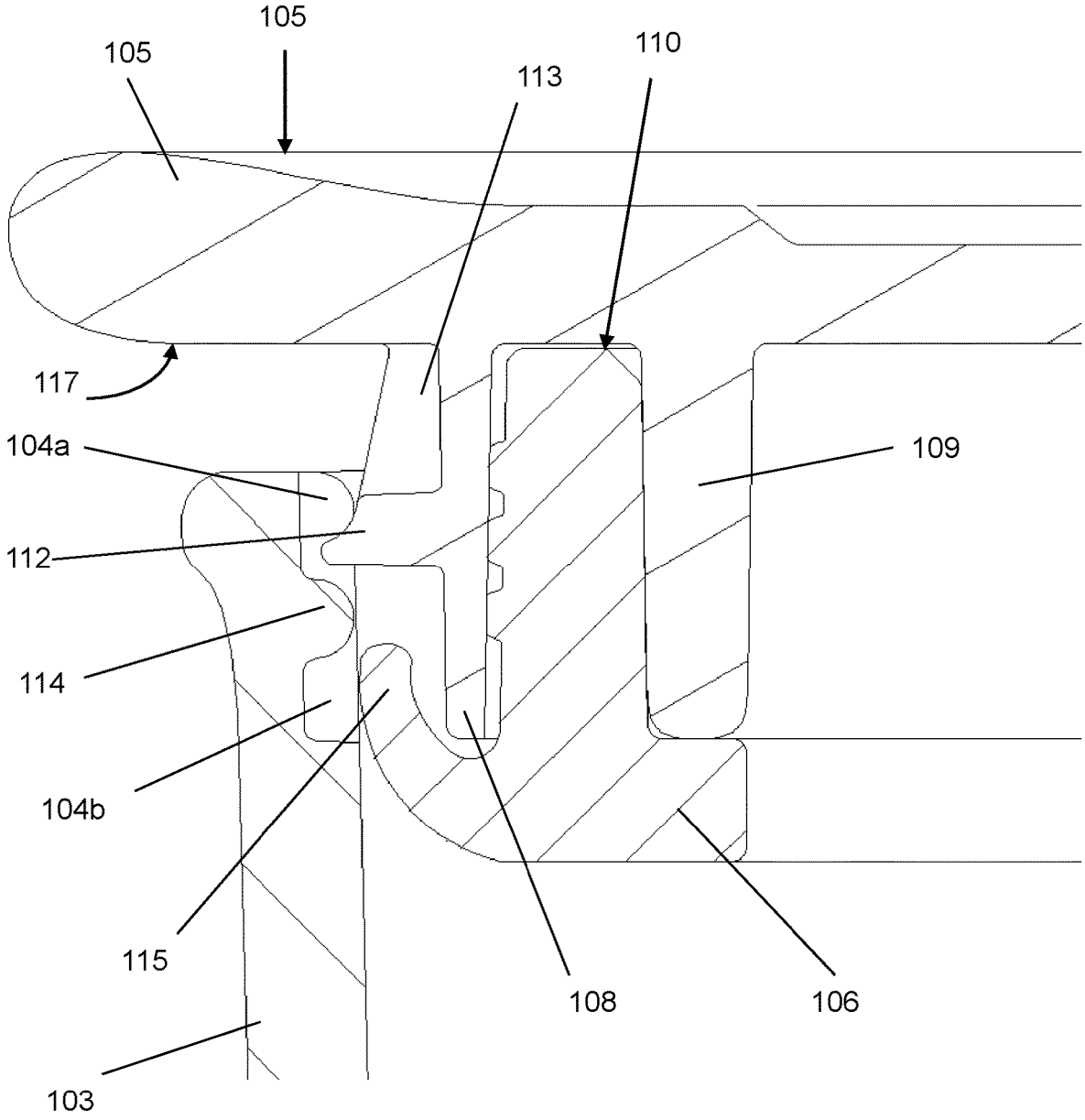
FIG. 11 illustrates a close-up cross-sectional view of the lid assembly in an open position according to the first exemplary embodiment.

FIG. 11 illustrates a close-up cross-sectional view of the lid assembly in an open position according to the first exemplary embodiment. To remove the lid assembly 101 from the body 102, the lid 105, via the lip 117, is pulled away from the body 102 to sufficiently overcome the negative air pressure imparted to the internal volume of the body 102. As the lip 117 of the lid 105 is pulled, the clip protrusion 112 disengages from the bump 114. The lip 115 of the gasket 106 abuts the divot 104, reforming the gaps with the gap. This allows air to enter the internal volume of the body 102 through the cavities 104*a*-104*b* and releases the negative air pressure within the body 102.

FIGS. 12-17 illustrate a second exemplary embodiment of the sealable container system according to the present invention.

Figure 12:
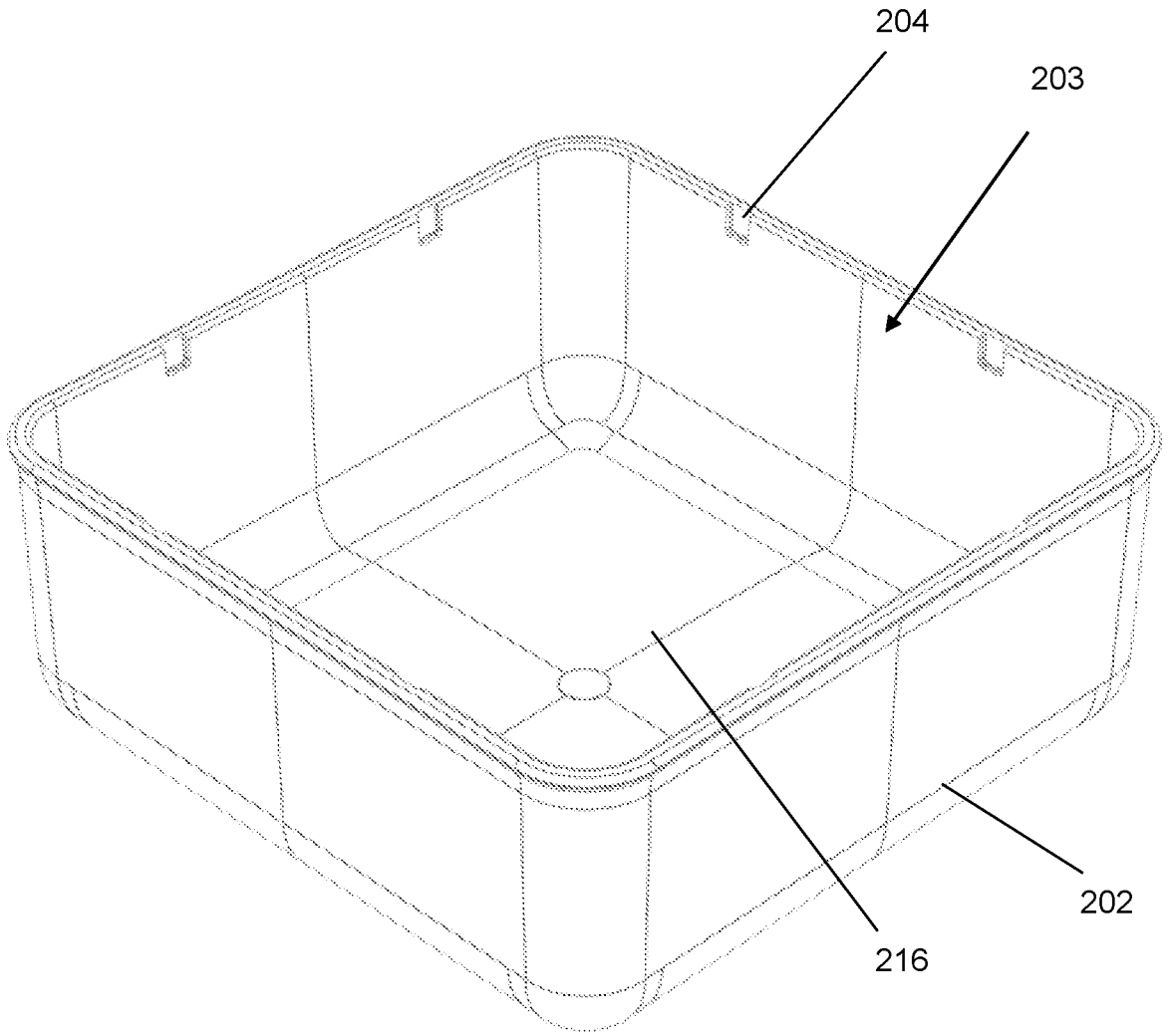
FIG. 12 illustrates a top perspective view of the body of the sealable container system according to the second exemplary embodiment.
Figure 13:
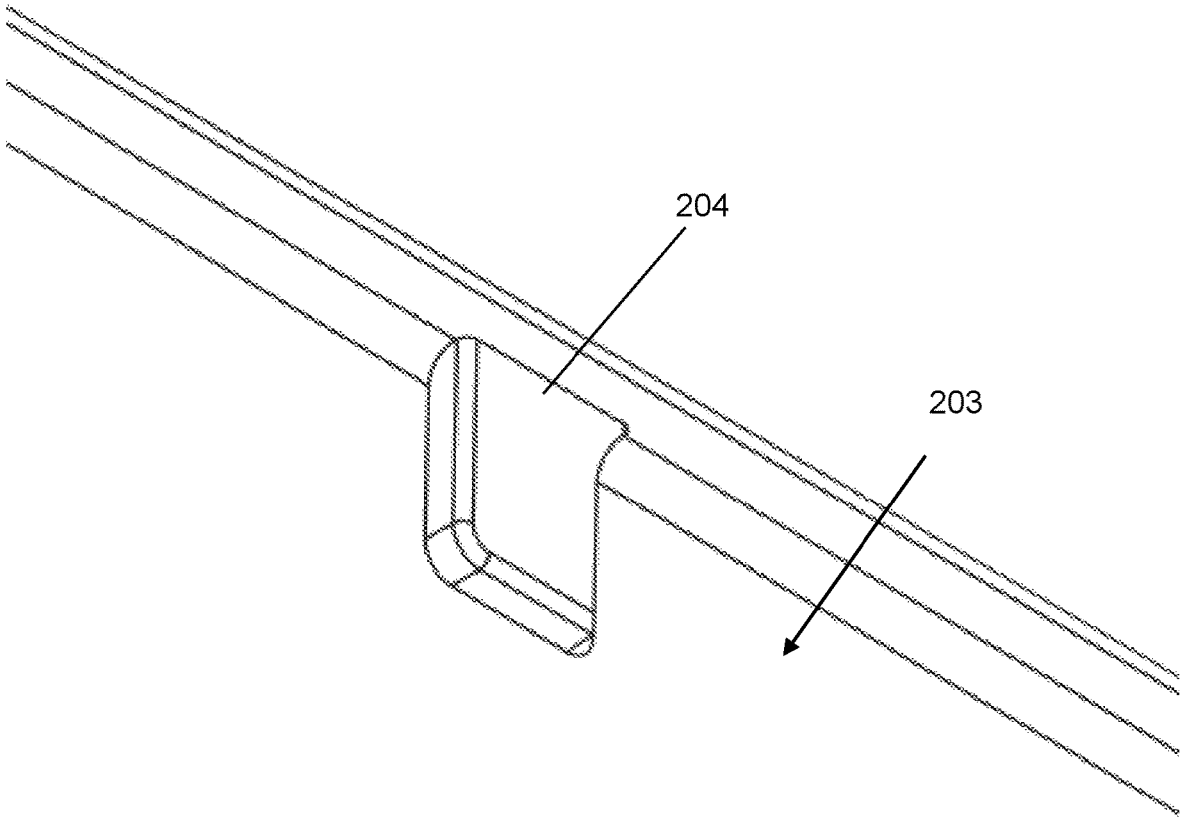
FIG. 13 illustrates a close-up perspective view of the divot according to the second exemplary embodiment.

FIG. 12 illustrates a top perspective view of the body of the sealable container system according to the second exemplary embodiment. The body 202 includes an open top end, a closed bottom end 216, and at least one side wall 203. The bottom end 216 and the side walls 203 define an internal volume in the body 202. The side walls 203 include one or more divots 204 residing in the upper edges of the side walls 203 proximate to the open top end and in the inside surfaces of the side walls 203. FIG. 13 illustrates a close-up perspective view of the divot according to the second exemplary embodiment. Each divot 204 is composed of a cavity in the upper edge and the inside surface of the side walls 203. Unlike the divot 103 illustrated in FIG. 4, no bump resides within the divot 204.

Figure 14A:
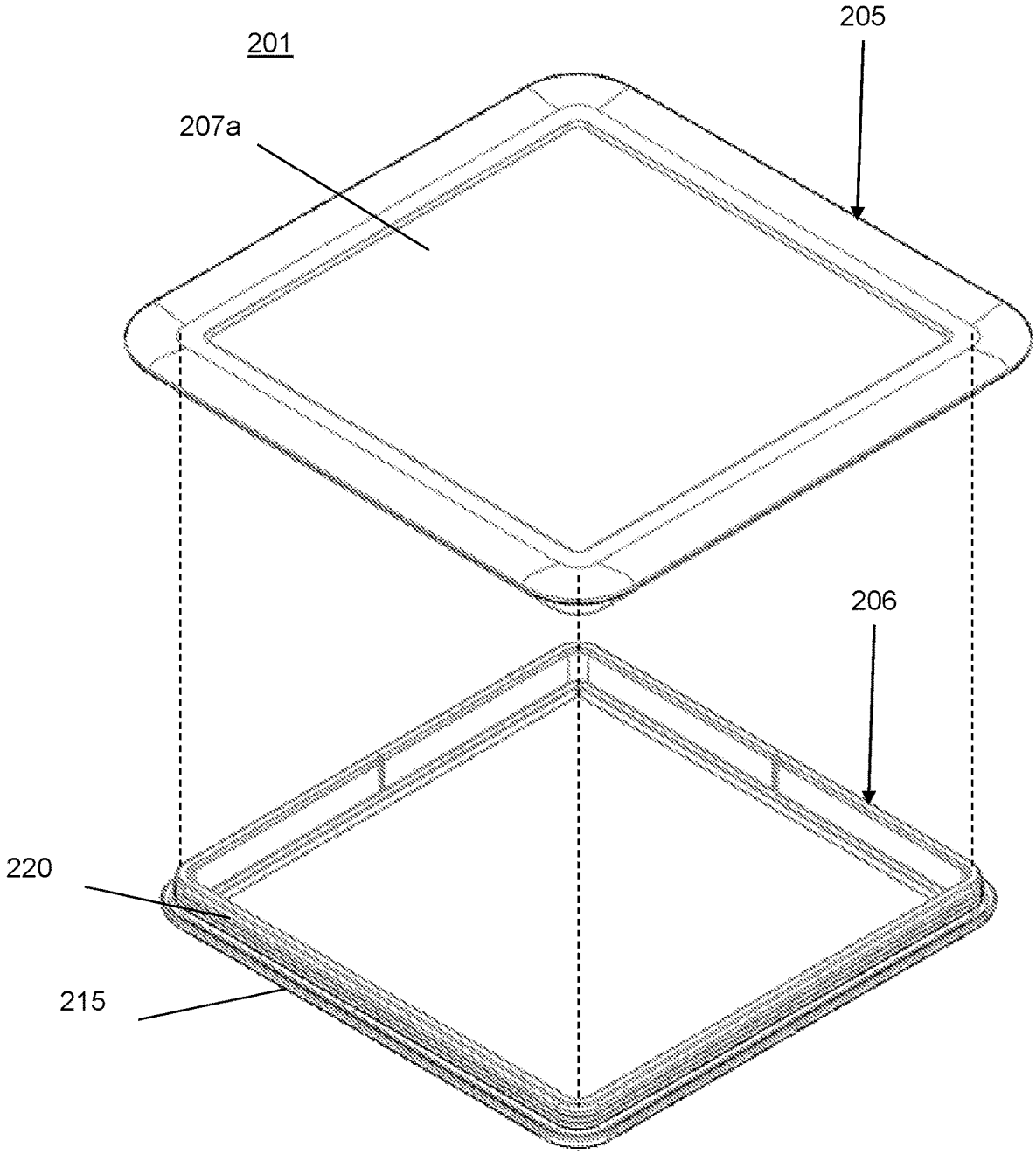
FIGS. 14A-14B illustrate a top exploded perspective view and a bottom exploded perspective view, respectively, of the lid assembly according to the second exemplary embodiment.
Figure 14B:
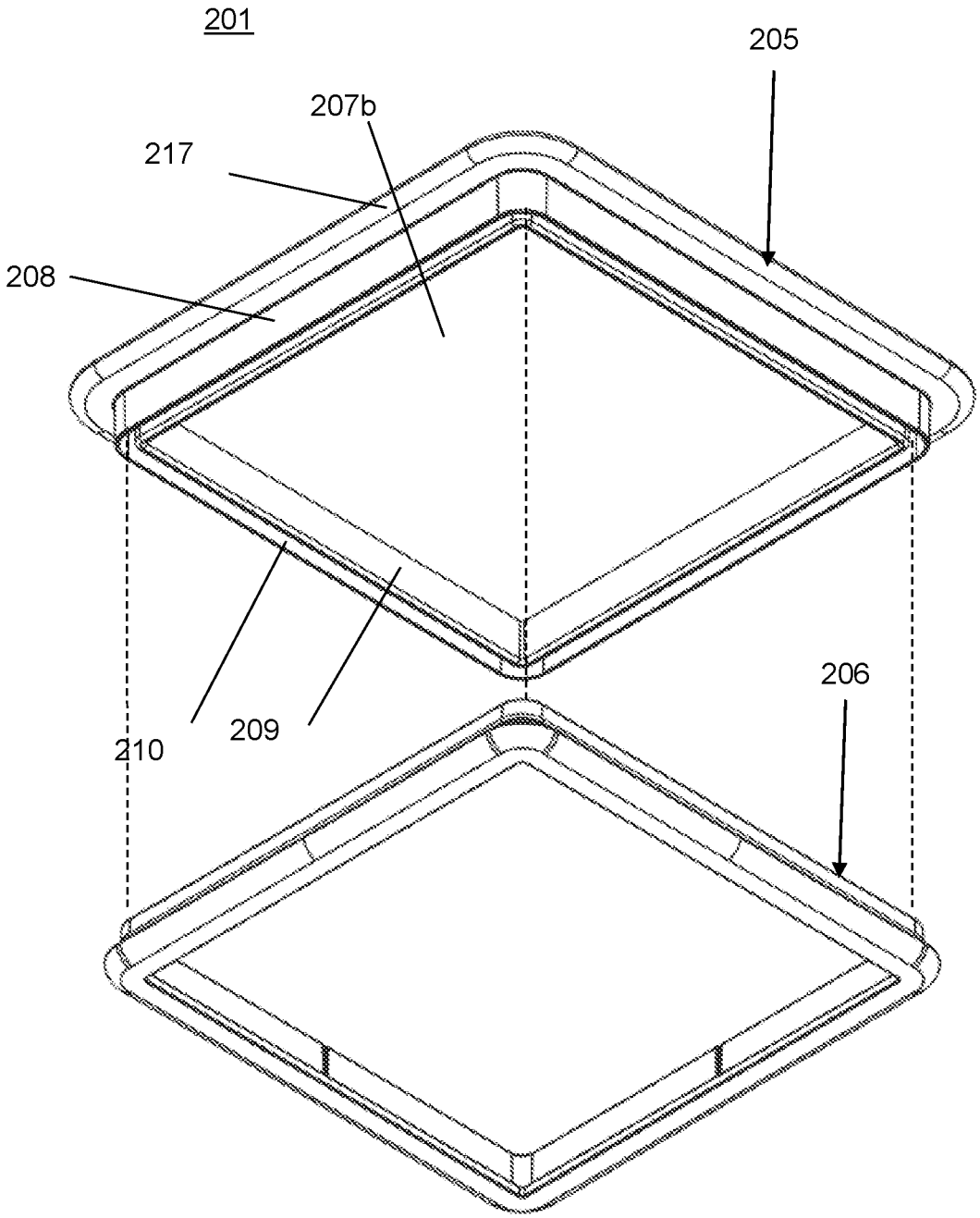

FIGS. 14A-14B illustrate a top exploded perspective view and a bottom exploded perspective view, respectively, of the lid assembly according to the second exemplary embodiment. The lid assembly 201 includes a lid 205 and an elastomeric gasket 206. The lid 205 includes a top side 207*a* and a bottom side 207*b*, with an outer wall 208 and an inner wall 209 residing at the bottom side 207*b* and projecting downward from the bottom side 207*b*. The outer 208 and inner 209 walls reside at the bottom side 207B such that a channel 210 exists between the outer 208 and inner 209 walls and a lip 217 exists at the outer edges of the lid 205. As illustrated in FIG. 14A, the gasket 206 includes a wall portion 220 and a lip 215 at the outer edges of the gasket 206. When engaged with the lid 205, the wall portion 220 of the gasket 206 resides within the channel 210, while the lip 215 resides outside of the channel 210. The lip 215 of the gasket 206 is configured for resilient deformation, as described further below. Contrary to the lid assembly 101 illustrated in FIGS. 5-6, the lid assembly 202 does not include any clips.

Figure 15:
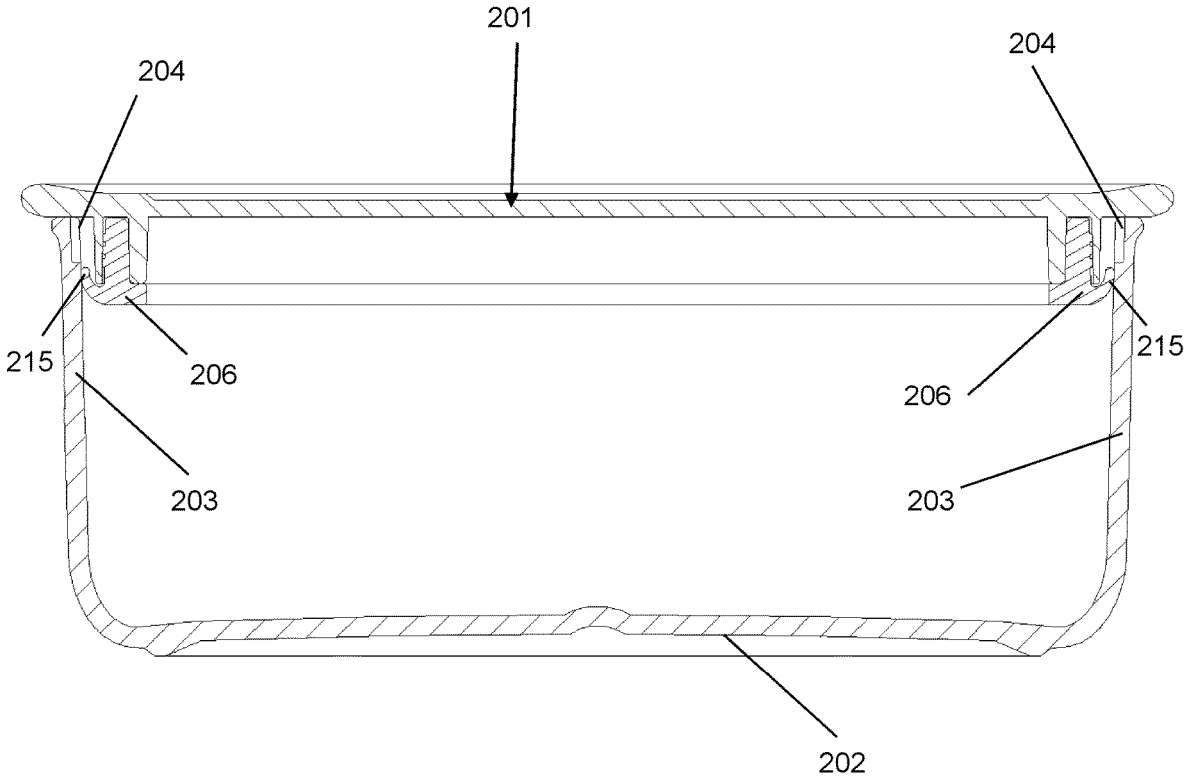
FIG. 15 illustrates a close-up cross-sectional view of the sealable container system according to the second exemplary embodiment.

FIG. 15 illustrates a close-up cross-sectional view of the sealable container system according to the second exemplary embodiment. When the lid assembly 201 engages the body 202 in a closed position, the lip 215 of the gasket 206 fully seats against the inside surface of the side walls 203 of the body 202.

Figure 16:
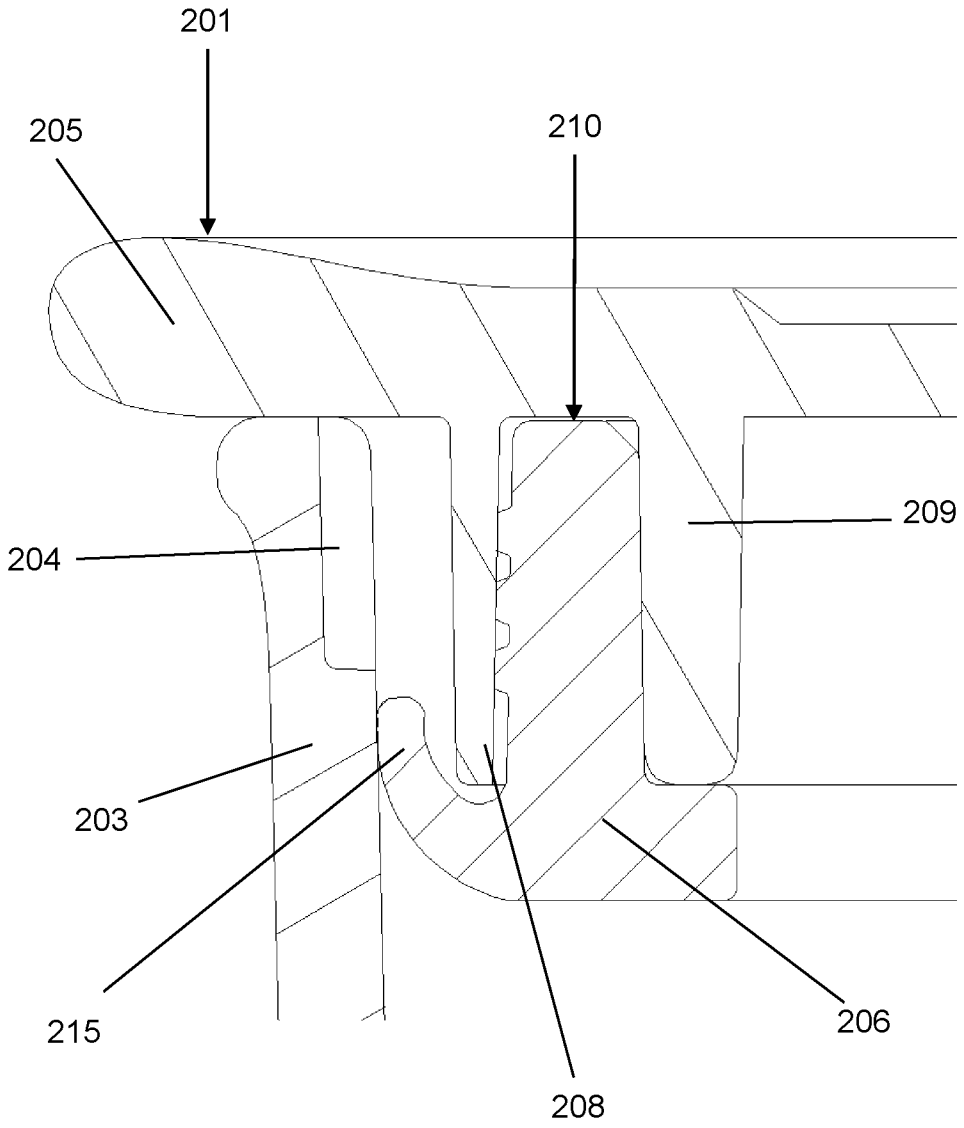
FIG. 16 illustrates a close-up cross-sectional view of the lid assembly in a closed position according to the second exemplary embodiment.

FIG. 16 illustrates a close-up cross-sectional view of the lid assembly in a closed position according to the second exemplary embodiment. As the lid assembly 201 is pressed into the open end of the body 202, the lip 215 of the gasket 206 abuts the divot 204, and the divot 204 forms a gap between the lip 215 and the inside surfaces of the side walls 203. This allows air in the internal volume of the body 202, that is displaced due to the pressing of the lid assembly 201, to exit through the gap. When the lip 215 travels past the divot 204, the lip 215 fully seats against the inside surface of the side wall 203, imparting negative air pressure to the internal volume of the body 202.

Figure 17:
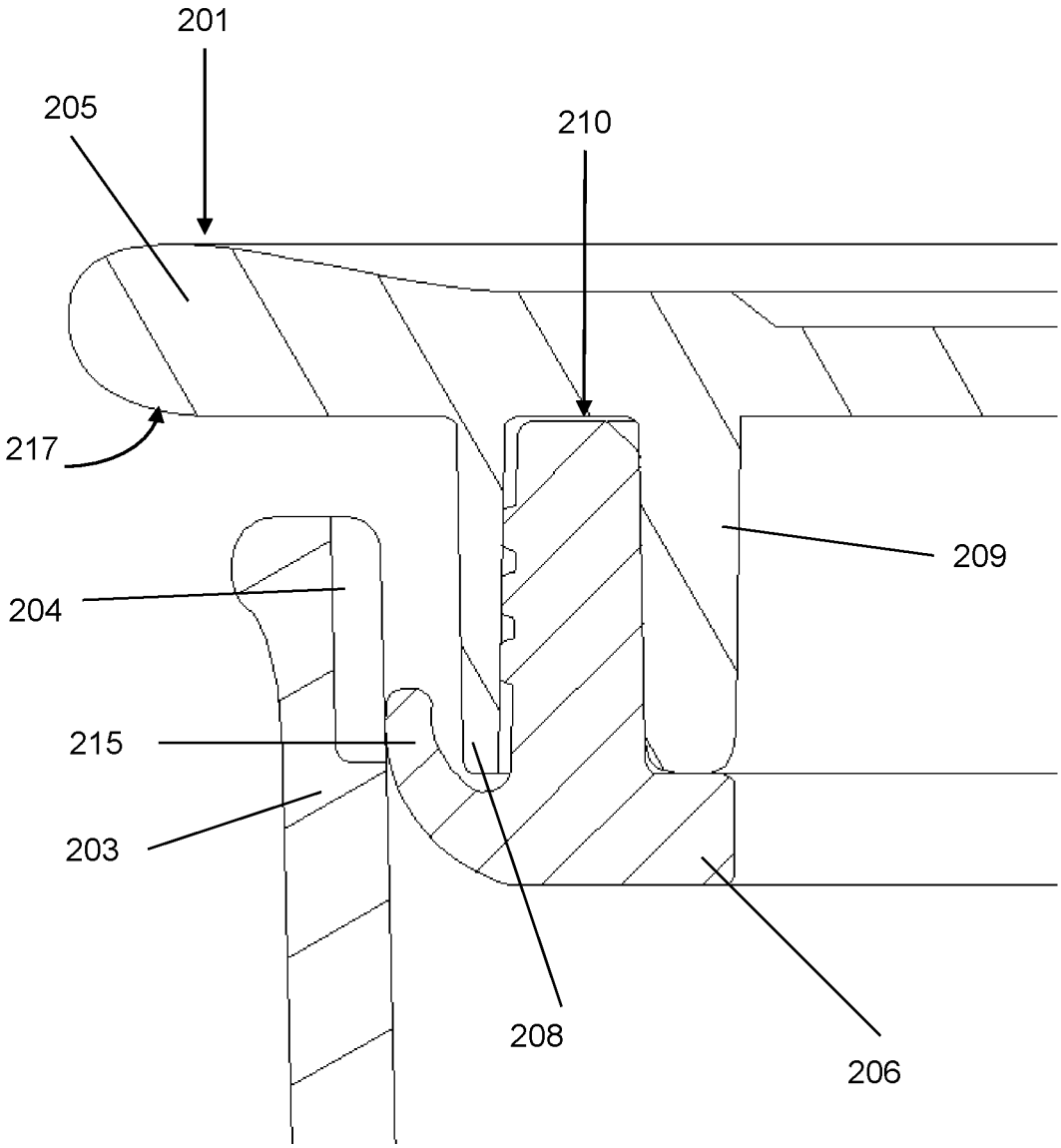
FIG. 17 illustrates a close-up cross-sectional view of the lid assembly in an open position according to the second exemplary embodiment.

FIG. 17 illustrates a close-up cross-sectional view of the lid assembly in an open position according to the second exemplary embodiment. To remove the lid assembly 201 from the body 202, the lid 205, via the lip 217, is pulled away from the body 202 to sufficiently overcome the negative air pressure imparted to the internal volume of the body 202. As the lip 217 of the lid 205 is pulled, the lip 215 of the gasket 206 abuts the divot 204, reforming the gap. This allows air to enter the internal volume of the body 202 through the gap and releases the negative air pressure within the body 202.

FIGS. 18-21 illustrate a third exemplary embodiment of the sealable container system according to the present invention. In this third exemplary embodiment, the sealable container system includes the lid assembly 101 illustrated in FIGS. 5-8.

Figure 18:
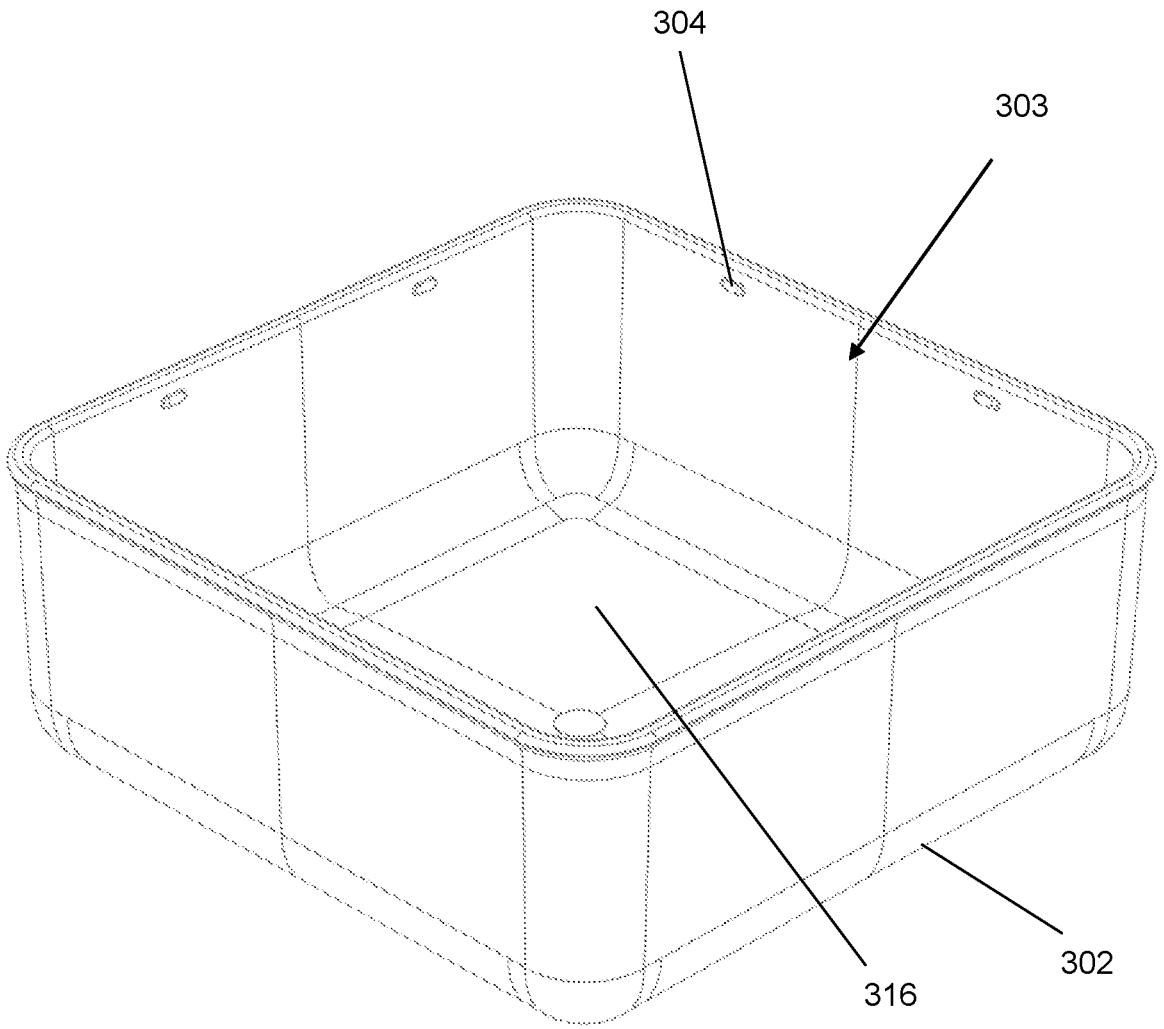
FIG. 18 illustrates a top perspective view of the body of the sealable container system according to the third exemplary embodiment.
Figure 19:
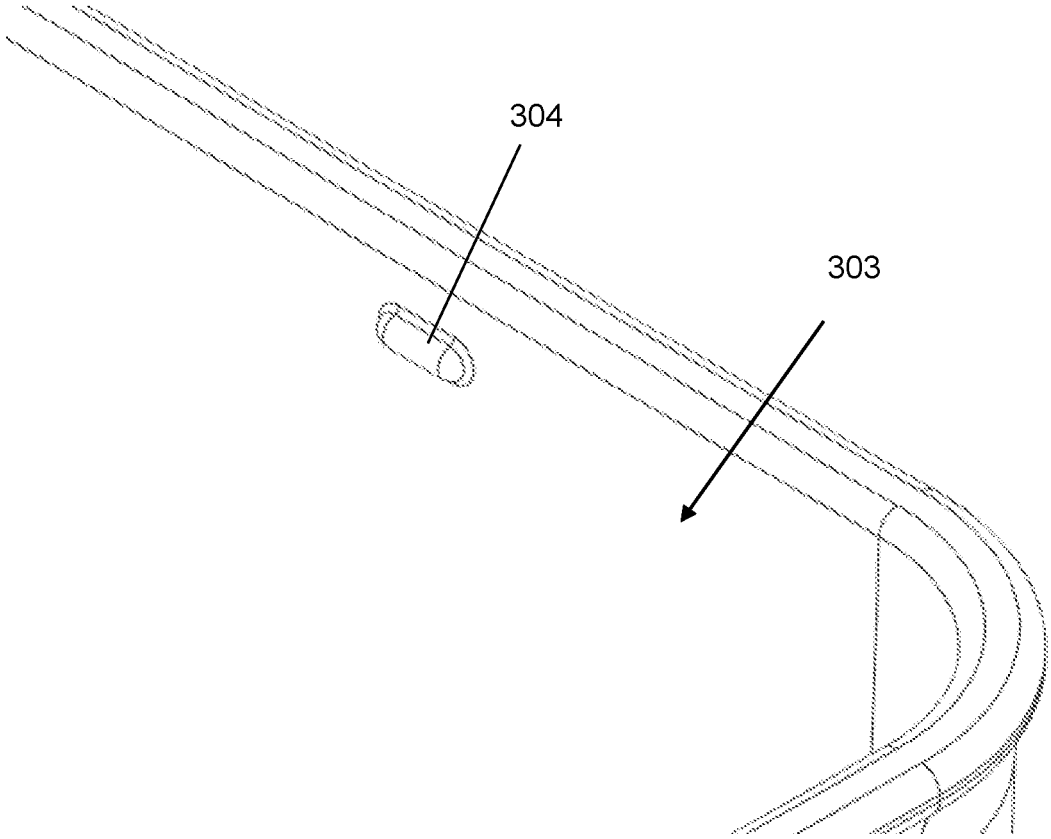
FIG. 19 illustrates a close-up perspective view of the bump according to the third exemplary embodiment.

FIG. 18 illustrates a top perspective view of the body of the sealable container system according to the third exemplary embodiment. The body 302 includes an open top end, a closed bottom end 316, and one or more side walls 303. The bottom end 316 and the side walls 303 define an internal volume in the body 302. The side walls 303 include one or more bumps 304 projecting away from an inside surface of the side walls 303 toward the internal volume in the body 302. FIG. 19 illustrates a close-up perspective view of the bump according to the third exemplary embodiment. In this exemplary embodiment, the bump 304 is of a partial tubular shape, however, other shapes may be used.

Figure 20:
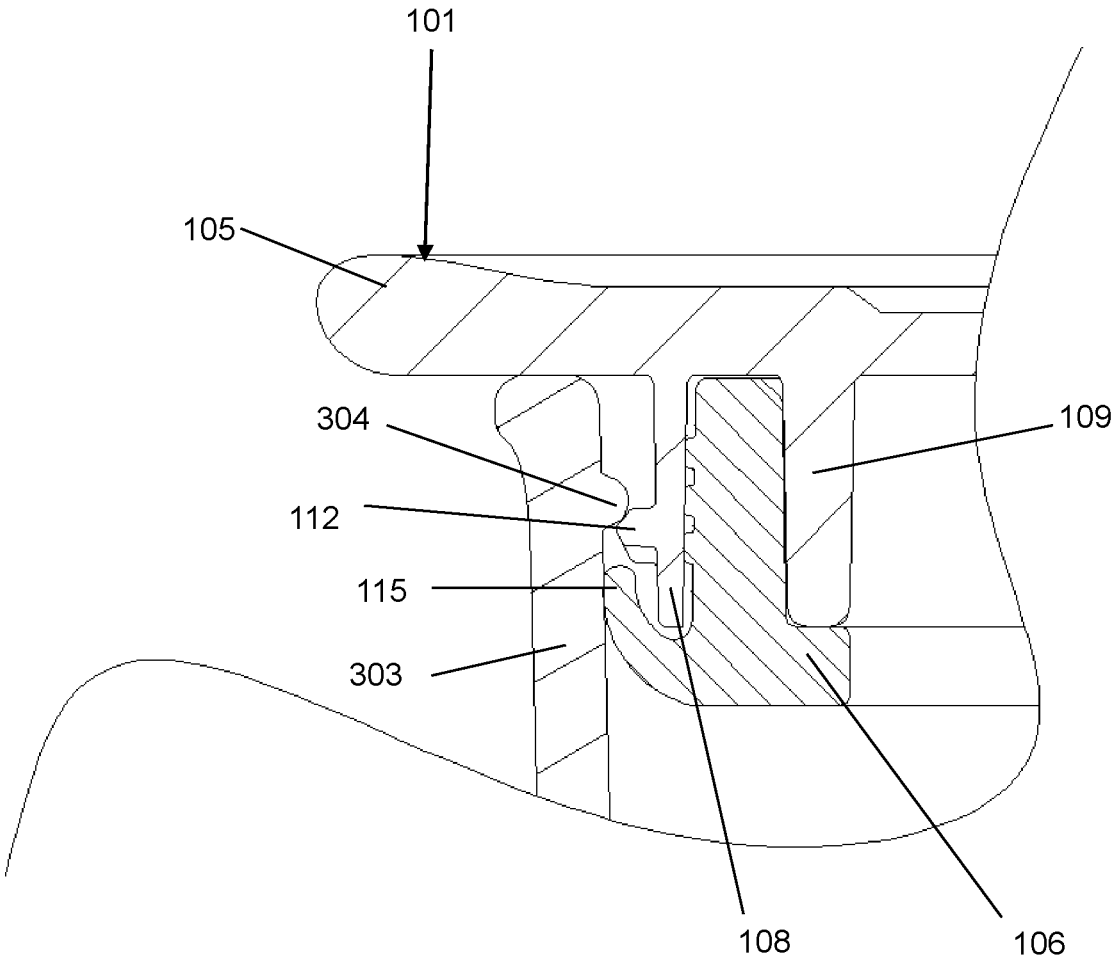
FIG. 20 illustrates a close-up cross-sectional view of the lid assembly in a closed position according to the third exemplary embodiment.

FIG. 20 illustrates a close-up cross-sectional view of the lid assembly in a closed position according to the third exemplary embodiment. As the lid assembly 101 is pressed into the open top end of the body 302, the lip 115 of the gasket 106 engages the bump 304. Upon engagement of the bump 304, the lip 115 deforms to accommodate the bump 304, such that a gap is formed between the lip 115 and the inside surfaces of the side walls 303. This allows air in the internal volume of the body 302, that is displaced due to the pressing of the lid assembly 101, to exit through the gap. When the lid assembly 101 continues to be pressed into the open top end of the body 302, the lip 115 of the gasket 106 eventually clears the bump 304, allowing the lip 115 to be fully seated against the inside surfaces of the side walls 303. Negative air pressure within the body 302 urges the lip 115 of the gasket 106 against the side walls 303 of the body 302 when the lid 105 is fully seated within the body 302. As the lid assembly 101 continues to be pressed into the body 302, the clip protrusion 112 eventually engages the lower portion of the bump 304. This creates resistance between the bump 304 and the clip protrusion 112, which assists in holding the lid assembly 101 in the closed position. In this exemplary embodiment, a tactile and/or audio feedback occurs when the clip protrusion 112 engages the bottom portion of the bump 304, signaling to the user that the lid assembly 101 is fully seated on the body 302.

Figure 21:
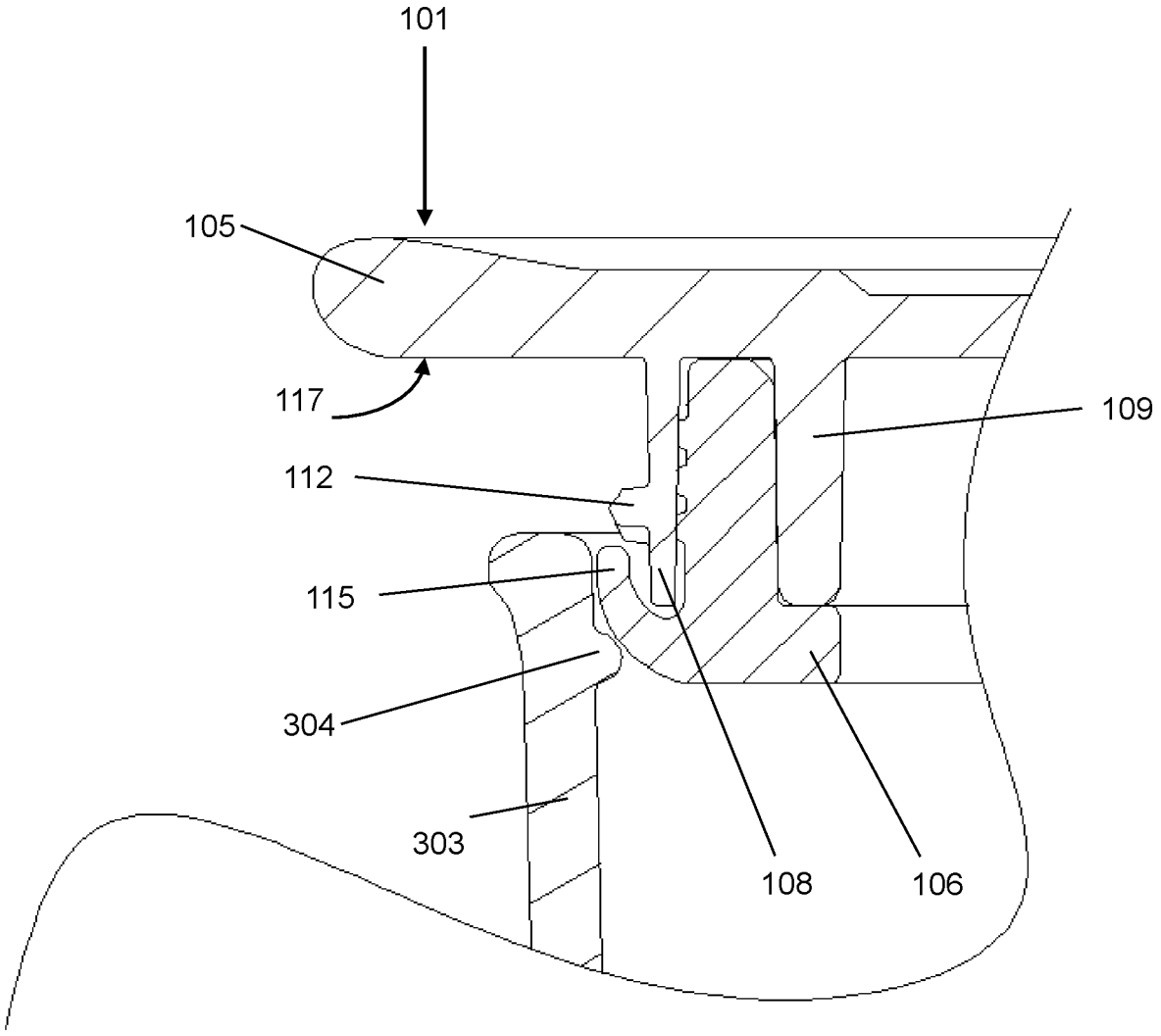
FIG. 21 illustrates a close-up cross-sectional view of the lid assembly in an open position according to the third exemplary embodiment.

FIG. 21 illustrates a close-up cross-sectional view of the lid assembly in an open position according to the third exemplary embodiment. To remove the lid assembly 101 from the body 302, the lid 105, via the lip 117, is pulled away from the body 302 to sufficiently overcome the negative air pressure imparted on the internal volume of the body 302. As the lip 117 is pulled, the clip protrusion 112 disengages from the bump 304, and the lip 115 of the gasket 106 engages the bump 304 such that the gaps re-form between the lip 115 of the gasket 106 and the inside surface of the side walls 303, allowing air to enter the internal volume of the body 302 through the gaps and releasing the negative air pressure within the body 302.

Figure 22:
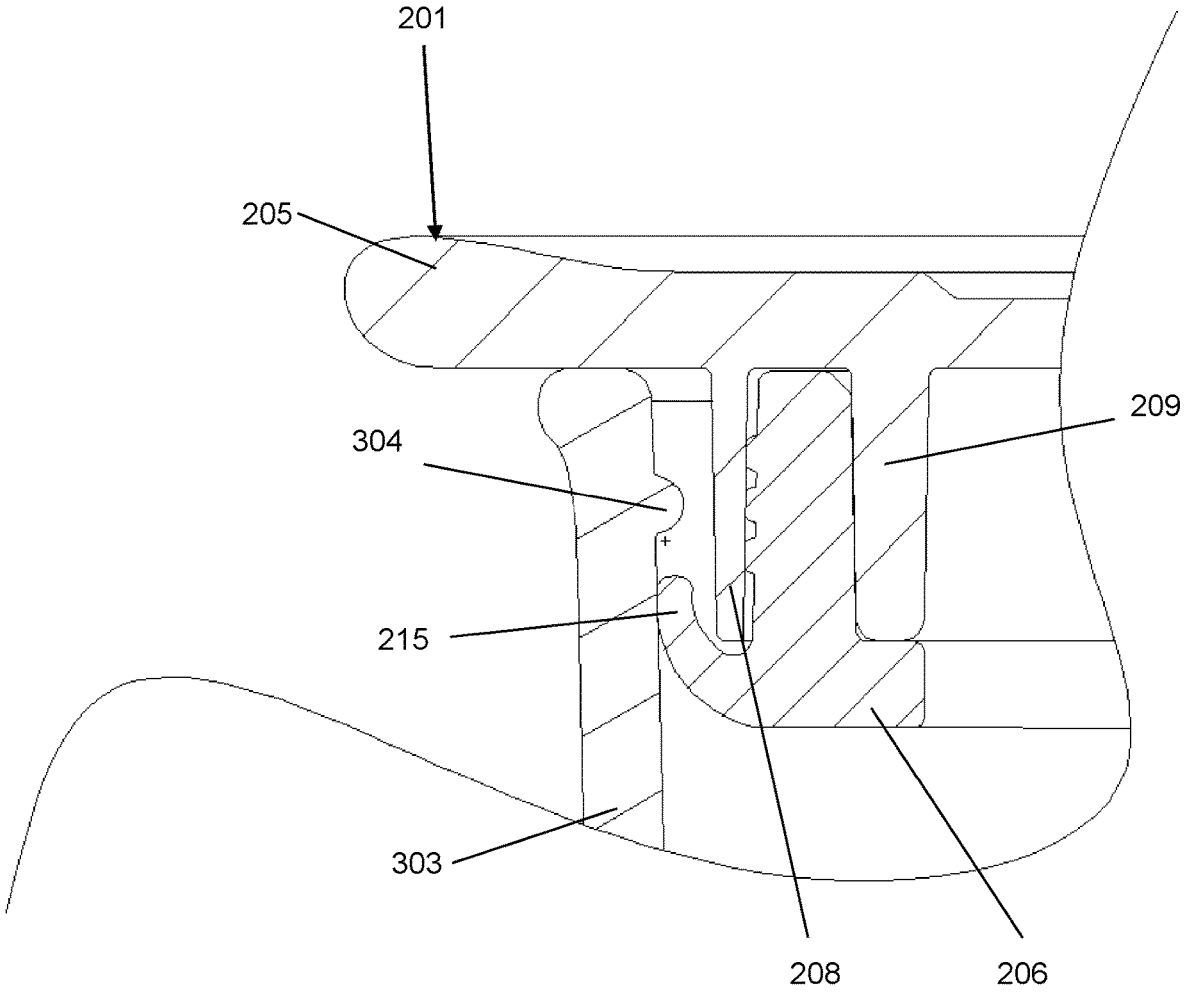
FIG. 22 illustrates a close-up cross-sectional view of the lid assembly in a closed position according to the fourth exemplary embodiment.
Figure 23:
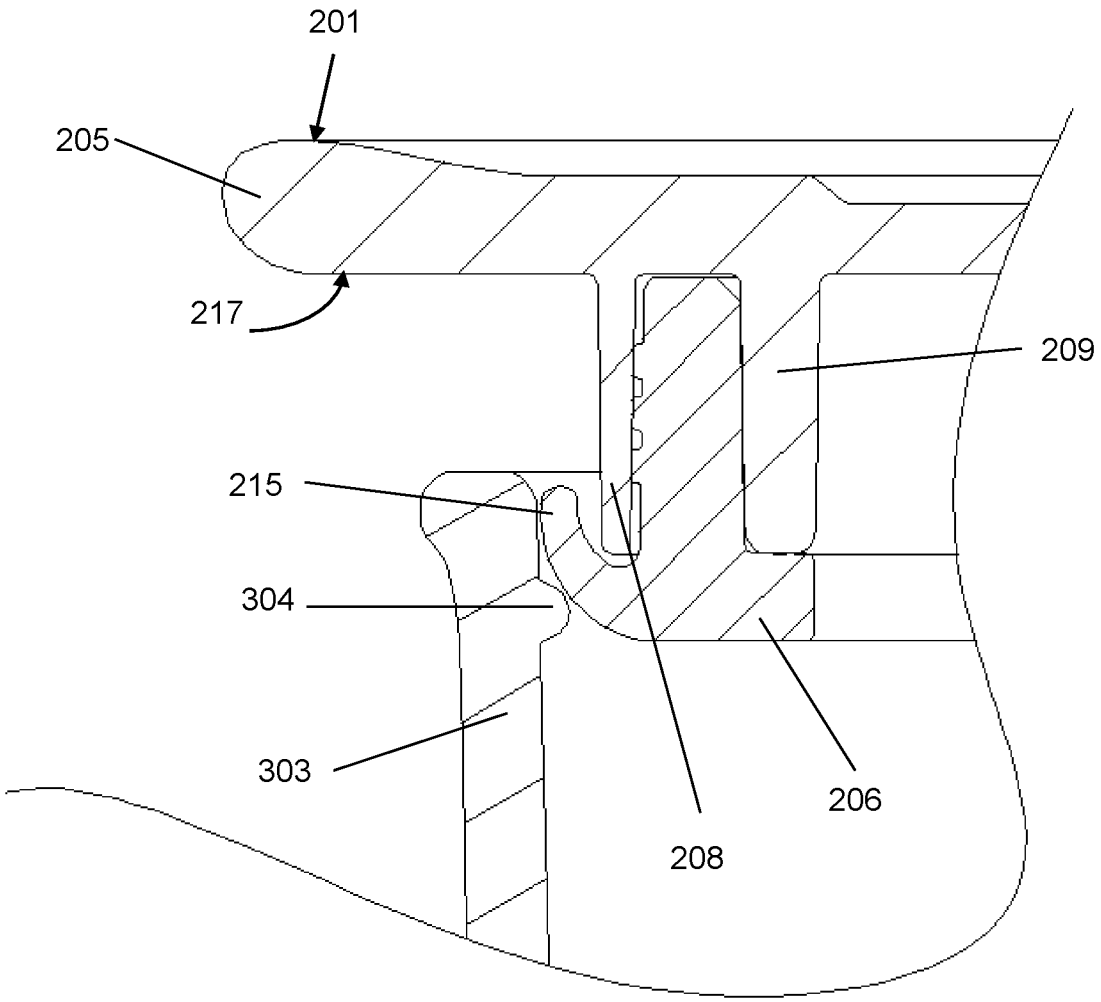
FIG. 23 illustrates a close-up cross-sectional view of the lid assembly in an open position according to the fourth exemplary embodiment.
Figure 24:
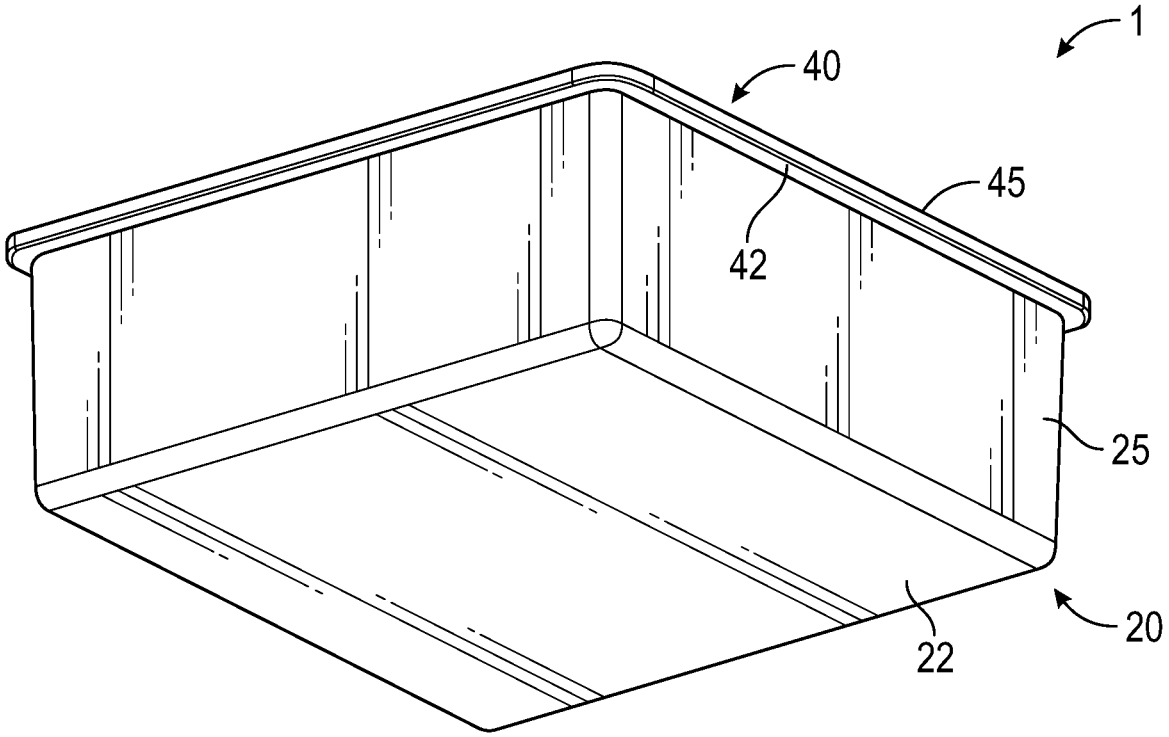
FIG. 24 illustrates a bottom perspective view of the sealable container system according to the fifth exemplary embodiment.

FIGS. 22-24 illustrate a fourth exemplary embodiment of the sealable container system according to the present invention. In this fourth exemplary embodiment, the sealable container system includes the body 302 illustrated in FIGS. 18-19 and the lid assembly 101 illustrated in FIGS. 14A-14B.

FIG. 22 illustrates a close-up cross-sectional view of the lid assembly in a closed position according to the fourth exemplary embodiment. As the lid assembly 201 is pressed into the open top end of the body 302, the lip 215 of the gasket 206 engages the bump 304. Upon engagement of the bump 304, the lip 215 deforms to accommodate the bump 304, such that a gap is formed between the lip 215 and the inside surfaces of the side walls 303. This allows air in the body 302, that is displaced due to the pressing of the lid assembly 201, to exit through the gap. When the lid assembly 201 continues to be pressed into the open top end of the body 302, the lip 215 of the gasket 206 eventually clears the bump 304, allowing the lip 215 to be fully seated against the side walls 303. Negative air pressure within the body 302 urges the lip 215 of the gasket 206 against the side walls 303 of the body 302 when the lid 205 is fully seated within the body 302.

FIG. 23 illustrates a close-up cross-sectional view of the lid assembly in an open position according to the fourth exemplary embodiment. To remove the lid assembly 201 from the body 302, the lid 205, via the lip 217, is pulled away from the body 302 to sufficiently overcome the negative air pressure imparted on the internal volume of the body 302. As the lip 217 is pulled, the lip 215 of the gasket 206 engages the bump 304 such that the gaps re-form between the lip 215 of the gasket 206 and the inside surface of the side walls 303, allowing air to enter the internal volume of the body 302 and releasing the negative air pressure within the body 302. The lid assembly 201 may then be completely removed from the body 302.

FIGS. 24-28 illustrate a fifth exemplary embodiment of the sealable container system according to the present invention.

Figure 25:
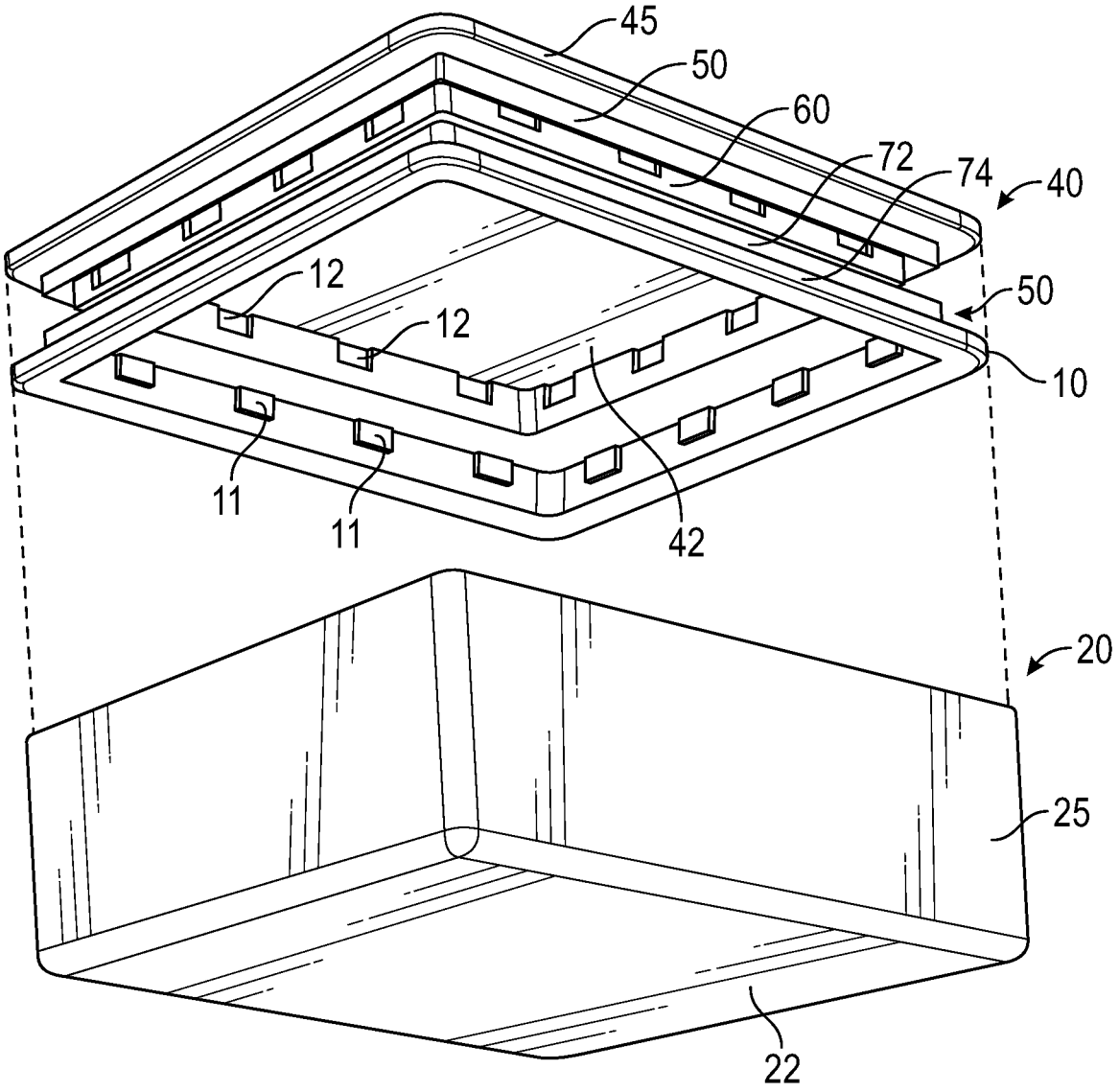
FIG. 25 illustrates a bottom exploded perspective view of the sealable container system according to the fifth exemplary embodiment.

FIG. 24 illustrates a bottom perspective view of the sealable container system according to the fifth exemplary embodiment. FIG. 25 illustrates a bottom exploded perspective view of the sealable container system according to the fifth exemplary embodiment. The sealable container system 1 includes a body 20 that has an open top end 28 (see FIG. 26), a closed bottom end 22, and at least one side wall 25. The bottom end 22 and the side walls 25 defines an internal volume 21 within the body 20. The side walls 25 include at least one protuberance or bump (FIGS. 26-28) projecting away from an inside surface of the side walls 25 towards the internal volume 21. Preferably the body 20 is made from a semi-rigid plastic injection-molded material. The body 20 may be opaque, translucent, or transparent.

Figure 28:
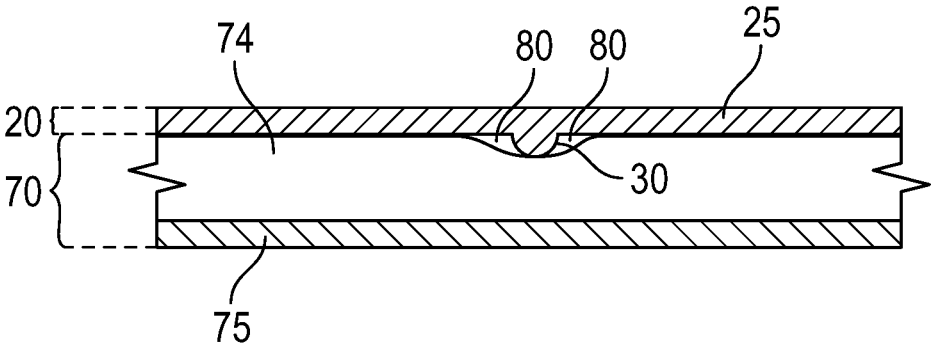
FIG. 28 is a cross-sectional view of the sealable container system according to the fifth exemplary embodiment.

A lid 40 has a top side 48, a bottom side 42, and a peripheral edge 45. An outside peripheral lip 50 projects downwardly from the bottom side 42 of the lid 40 proximate the peripheral edge 45, and an inside peripheral lip 60 projects downwardly from the bottom side 42 of the lid 40 proximate the outside peripheral lip 50 and generally parallel thereto (FIG. 28). Preferably the lid 40 is made from a semi-rigid, transparent plastic injection-molded material.

An elastomeric gasket 70 has a retention leg 72 configured for securing between the inside and outside peripheral lips 50, 60 of the lid 40. The gasket 70 has a resilient sealing lip 74 projecting away from the retention leg 72 at a bottom side thereof. The sealing lip 74 is configured for resilient deformation by the at least one peripheral wall 25 of the container base 20. Preferably the retention leg 72 of the gasket 70 further includes a plurality of elastomeric, resilient rectanguloid pegs 11 adapted to interlock with the corresponding apertures 12 in the inside peripheral lip 60. Alternately the pegs 11 may be configured to engage the apertures 12 in the outside peripheral lip 50 (not shown). Although the lid 40 is shown with the inside peripheral lip 60, the pegs 110, and the apertures 12, the lid 40 can also be constructed as a single piece with an integrated elastomeric gasket 70.

As such, as the lid 40 is pressed into the open top end 28 of the body 20, the sealing lip 74 is deformed upward by air being displaced within the body 20 and the sealing lip 74 is pressed against the inside surface 24 of the side walls 25. As the lid 40 continues to be pressed into the open top end 28, the sealing lip 74 eventually engages the protuberance 30. The protuberance 30 is preferably a partial sphere or dome but can be other shapes as well. The protuberance 30 may also include a plurality of structures that, as a combination, provide a desired texture. Upon engagement of the protuberance 30, the sealing lip 74 deforms to accommodate the protuberance 30, such that a gap 80 is formed between the sealing lip 74 and the inside surface 24 on both sides of the protuberance 30. When the lid 40 continues to be pressed into the open top end 28, the sealing lip 74 eventually clears the protuberance 30, allowing the sealing lip 74 to be fully seated against the side walls 25. Negative air pressure within the body 20 urges the sealing lip 74 against the side walls 25 of the body 20 when the lid 40 is fully seated within the body 20. Further, the top surface 48 of the lid 40 may be pressed in a center or any portion thereof to expel additional air out of the body 20 past the sealing lip 74, whereupon the sealing lip 74*re*-seals the body 20 and maintains the negative air pressure within the body 20.

Thereafter, upon pulling the lid 40 away from the body 20 sufficiently to overcome the negative pressure imparted to the internal volume 21, the sealing lip 74 passes the at least one protuberance such that the gaps re-form between the sealing lip 74 and the inside surface 24 of the side walls 25, allowing air into the body 20 to further release the lid 40.

Figure 26:
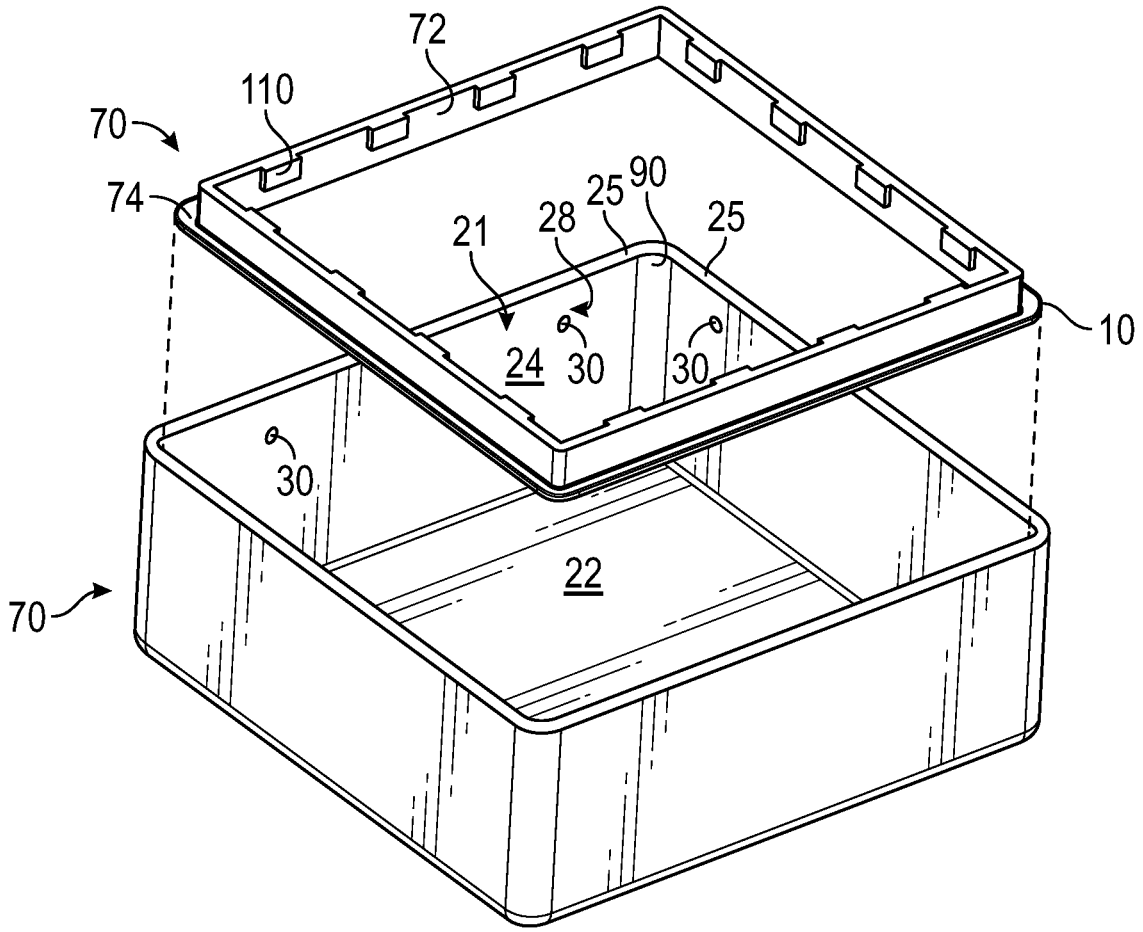
FIG. 26 is a top exploded perspective view of the body and gasket of the sealable container system according to the fifth exemplary embodiment.
Figure 27:
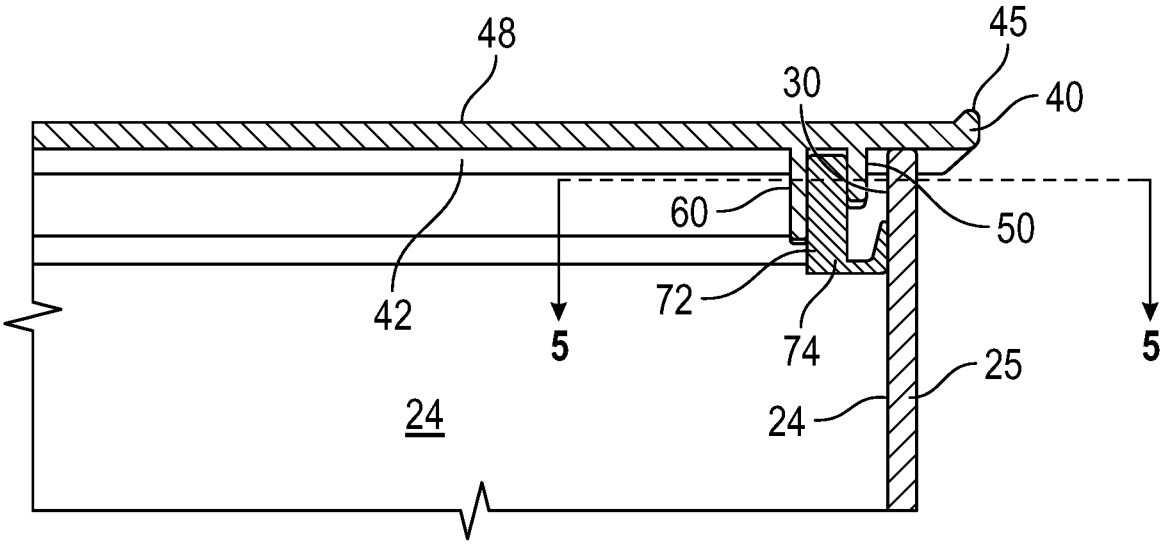
FIG. 27 is a cross-sectional view of the sealable container system according to the fifth exemplary embodiment.

In some embodiments, the body 20 is circular in plan view (not shown) and having one side wall 25, or triangular in plan view (not shown) having three of the side walls 25. Preferably, however, the body 20 is rectangular or square in plan view, the body 20 having four side walls 25 and the lid 40 having four peripheral edges 45. As such, inside corners formed between each side wall 25 of the body 20 each have an inside radius 90 configured to match an outside radius 100 of corners of the sealing lip 74 of the gasket 70 (FIG. 26). Further, in such an embodiment preferably there are at least two of the protuberances 30 on the inside surfaces 24 of each of the four side walls 25.

Although the bodies 20, 102, 202, and 302 in the exemplary embodiments are disclosed above with rectangular shapes, any of the bodies 20, 102, 202, 302 may alternatively have a non-rectangular shape (e.g. circular shape), without departing from the spirit and scope of the present invention. Similarly, any of the lid assemblies 40, 101, and 201 may have an alternative shape to match the shape of their corresponding bodies 20, 102, 202, 302.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A sealable container system, comprising: a body, comprising: an open top end; a closed bottom end; at least one side wall comprising a non-curved inside surface, wherein the closed bottom end and the at least one side wall define an internal volume with the body; and one or more bumps residing on the non-curved inside surface of the at least one side wall and projecting away from the non-curved inside surface of the at least one side wall and toward the internal volume, wherein the one or more bumps reside on the non-curved inside surface of the at least one side wall between a lip of the at least one side wall and the closed bottom end; and a lid assembly, comprising: a lid, comprising a top side and a bottom side opposite the top side; an outer wall and an inner wall residing at the bottom side and projecting downward from the bottom side; a channel between the outer wall and the inner wall; and a gasket, comprising a wall portion and a lip, wherein when the gasket engages the lid, the wall portion resides within the channel and the lip resides outside the channel, wherein when the lid assembly is pressed into the open end of the body, the lip of the gasket engages the one or more bumps and deforms to accommodate the one or more bumps, wherein a gap between the lip of the gasket and the inside surface of the at least one side wall is formed, wherein air in the internal volume exits through the gap, wherein when the lip of the gasket travels past and disengages from the one or more bumps, the lip of the gasket fully seats against the inside surface of the at least one side wall, wherein negative air pressure is imparted to the internal volume of the body.

2. The system of claim 1, further comprising:

wherein when the lid assembly is pulled away from the body, the lip of the gasket abuts the one or more bumps and reforms the gap, wherein air is allowed to enter the internal volume through the gap.

3. A sealable container system, comprising:

a body, comprising:

an open top end;

a closed bottom end;

at least one side wall, wherein the closed bottom end and the at least one side wall define an internal volume with the body; and one or more bumps residing on the at least one side wall and projecting away from an inside surface of the at least one side wall and toward the internal volume; and a lid assembly, comprising:

a lid, comprising a top side and a bottom side opposite the top side;

an outer wall and an inner wall residing at the bottom side and projecting downward from the bottom side;

a channel between the outer wall and the inner wall; and a gasket, comprising a wall portion and a lip, wherein when the gasket engages the lid, the wall portion resides within the channel and the lip resides outside the channel, wherein when the lid assembly is pressed into the open end of the body, the lip of the gasket engages the one or more bumps and deforms to accommodate the one or more bumps, wherein a gap between the lip of the gasket and the inside surface of the at least one side wall is formed, wherein air in the internal volume exits through the gap, wherein when the lip of the gasket travels past the one or more bumps, the lip of the gasket fully seats against the inside surface of the at least one side wall, wherein negative air pressure is imparted to the internal volume of the body, wherein the lid assembly further comprises one or more clips residing on an outer surface of the outer wall of the lid, wherein, each clip comprises a clip protrusion projecting outward from the outer wall of the lid, wherein when the lip of the gasket fully seats against the inside surface of the at least one side wall, the clip protrusion engages the bump and creates resistance between the bump and the clip protrusion.

4. The system of claim 3, wherein when the lid assembly is pulled away from the body, the clip protrusion disengages from the bump.

* * * * *